US007641407B2

(12) United States Patent
Mochizuki

(10) Patent No.: US 7,641,407 B2
(45) Date of Patent: Jan. 5, 2010

(54) PREVENTION OF DAMAGE TO AN OPTICAL DISK IN A PRINTER DUE TO INADVERTENT HANDLING

(75) Inventor: Yoshiaki Mochizuki, Tokyo (JP)

(73) Assignee: Casio Computer Co., Ltd., Tokyo (JP)

( * ) Notice: Subject to any disclaimer, the term of this patent is extended or adjusted under 35 U.S.C. 154(b) by 624 days.

(21) Appl. No.: 11/410,410

(22) Filed: Apr. 25, 2006

(65) Prior Publication Data

US 2006/0245811 A1 Nov. 2, 2006

(30) Foreign Application Priority Data

Apr. 27, 2005 (JP) ..... 2005-129443
Mar. 17, 2006 (JP) ..... 2006-075541

(51) Int. Cl.
*B41J 29/13* (2006.01)
*B41J 29/00* (2006.01)
*B41J 29/12* (2006.01)

(52) U.S. Cl. ..... 400/668; 400/693; 400/679

(58) Field of Classification Search ..... None
See application file for complete search history.

(56) References Cited

U.S. PATENT DOCUMENTS 4,538,515 A * 9/1985 Tymkewicz et al. ..... 101/216

FOREIGN PATENT DOCUMENTS

| | | | | |
|---|---|---|---|---|
| JP | 60-172575 | A | | 9/1985 |
| JP | 62090685 | A | * | 4/1987 |
| JP | 04065273 | A | * | 3/1992 |
| JP | 04333066 | A | * | 11/1992 |
| JP | 09101723 | A | * | 4/1997 |
| JP | 2000-225746 | A | | 8/2000 |
| JP | 2003-072155 | A | | 3/2003 |
| JP | 2004082654 | A | * | 3/2004 |
| JP | 2005-099415 | A | | 4/2005 |

* cited by examiner

*Primary Examiner*—Daniel J Colilla
(74) *Attorney, Agent, or Firm*—Frishauf, Holtz, Goodman & Chick, P.C.

(57) ABSTRACT

A printer for printing character information on an optical disk using an ink cartridge. The printer comprises a printer cover for opening/closing a cartridge receiving section into which the ink cartridge will be loaded. When the ink cartridge is loaded into the cartridge receiving section, the cover is closed and then the optical disk is inserted into the printer. Then, printing is started. The cover is engaged with the printer body in a closed state. The cover is disengaged by operating an operation button. When the optical disk is inserted into the printer body, an inlet cover is pushed by the optical disk so as to be upstanding. This causes a lock member to protrude so as to engage with the operation button, thereby locking the operation button and hence rendering the cover unopenable.

19 Claims, 30 Drawing Sheets

PREVENTION OF DAMAGE TO AN OPTICAL DISK IN A PRINTER DUE TO INADVERTENT HANDLING

BACKGROUND OF THE INVENTION

1. Technical Field

The present invention relates to printers and more particularly to a printer that prints on a recording medium on which data is recordable.

2. Background Art

In the past, there have been printers that print characters of a title for data recorded on a recording medium such as an optical disk comprising a CD-R (Compact Disk-Recordable) where data is recorded as disclosed, for example, in Japanese patent publication 2003-72155. These printers comprise a tray where a recording medium is loaded. The tray is movable between the inside of the printer body and its outside. When data is printed, the tray is moved away from the printer body, a recording medium is loaded on the tray, the tray with the recording medium thereon is returned into the printer body and a printing mechanism provided within the printer body prints on the recording medium. The printing mechanism comprises a carriage on which a thermal head is mounted. The carriage is moved above the tray received within the printer body to print on the recording medium on the tray in a predetermined range. However, the printers' structure is not necessarily simple because the printer body includes the tray with the recording medium loaded thereon is moved relative to the printer body and the printing mechanism that moves the carriage, on which the thermal head is mounted, within the printer body.

In view of these conventional printers, the applicants invented an improved printer for printing on a recording medium, and more particularly, a printer comprising an improved printing mechanism that prints on a conventional printing tape, as disclosed in Japanese patent publication 2000-225746.

The printing mechanism of this printer comprises a printing mechanism where a thermal head and a platen are placed upstanding in opposing relationship at a predetermined position within the printer body. An ink cartridge containing an ink ribbon is loadable into a cartridge receiving section provided at a predetermined position within the printer body in order to supply the printing mechanism with the ink ribbon. By driving the printing mechanism, a recording medium set in the upstanding state is conveyed along with the ink ribbon such that data is printed in a thermal transferring manner on a label surface of the recording medium.

As in the conventional tape printer, in this printer when a tape cartridge that contains a printing tape and an ink ribbon is loaded into the cartridge receiving section, thermal transfer printing is performed on the printing tape. When an ink cartridge that contains a recording medium and an ink ribbon is loaded into the cartridge receiving section, printing is performed on the recoding medium. In this case, the printer body is flat box-shaped and has a small height dimension compared to the diameter dimension of a disk-like recording medium. Thus, in order that the recording medium is loaded in an upstanding state into the printer body and conveyed upstanding while being printed, a slit-like inlet through which the recording medium is inserted is provided along the conveyance passage in a printer cover positioned above the conveyance passage for covering the cartridge receiving section openably.

In this printer, the cover is opened and then an ink cartridge is loaded into the cartridge receiving section. Then the cover is closed, and an upstanding recording medium is loaded at a set position within the printer body through the slit-like inlet in the printer cover. In this state, substantially an upper half of the printing medium appears outside the cover, a middle portion of the printing medium is in the slit-like inlet in the cover and substantially a lower half of the printing medium is loaded into the printer body. When the printing mechanism starts to print, an ink in the ink ribbon is transferred by heat produced by the thermal head to the label surface of the recording medium that is held between the thermal head and the platen and conveyed upstanding along with the ink ribbon in an superimposed manner.

This printer is constructed based on the conventional tape printer. A keyboard is provided on the user's side part of an upper or front surface of the printer body, including keys for inputting information to be printed, performing various setting operations and giving various commands about print control. A liquid crystal display that displays information to be printed and/or necessary for printing and the cartridge receiving section where a tape cartridge is loaded exchangeably are disposed side by side right and left at positions remote from the user on the front surface of the printer body with an openable cover for the display and the cartridge receiving section. This is a widely employed layout of the printer.

In order to load and unload a cartridge into and from the cartridge receiving section easily in this printer, the cartridge receiving section has a large opening, the cover that normally covers the cartridge receiving section is attached rotatable to the printer body by hinges provided at the back of the printer body such that an open cover is not a hindrance to the cartridge exchanging operation. When the cover is open, it is upstanding or at an angle of 90 degrees or more at the back of the printer body compared to a state where the cover is closed. An engaging mechanism is provided between the cover and the printer body for maintaining the cover closed against the printer body. An operating button is provided on the front surface of the printer body to release the engaging state of the engaging mechanism when the cover is opened. An uplifting mechanism is provided to uplift the cover on the opposite free end side of the cover from the hinges in a releasing direction when the engaged state of the cover by the engaging mechanism is released. This facilitates an opening operation of the cover subsequent to its releasing operation.

When it is found that no ink cartridge is loaded after a recording medium is loaded into the printer body or exchange of an ink cartridge once loaded with another one of a different color is desired, the cover need be opened for loading or exchanging purposes. However, when the cover is opened inadvertently with the recording medium set into the printer body, an inner edge of the slit-like inlet in the cover will possibly hit the label surface of the recording medium, thereby damaging the same.

More particularly, in this printer the conveying direction of the recording medium, the extending direction of the slit-like inlet in the cover and the label surface of the recording medium set into the printer body are parallel to the extending direction of the hinge axle around which the cover is turned for opening/closing the cartridge receiving section. When the cover is turned around the hinge axle in the opening direction, the inner edge of the slit-like inlet will possibly hit the label surface of the recording medium, thereby damaging the same.

When the user inadvertently pushes the operation button that releases the engagement of the cover with the printer body after the recording medium is loaded into the printer body, the uplifting mechanism starts to operate such that the cover is lifted on its free-end side and the inner edge of the inlet in the cover will hit the recording medium, thereby causing the recording medium to deviate from its set position within the printer body and hence from its printing position.

When the cover is disengaged from the printer body in an incomplete closed state, the inner edge of the inlet would hit the label surface of the recording medium that is conveyed along the inlet or the conveyance of the recording medium would be hindered, thereby providing no good printing.

SUMMARY OF THE INVENTION

The present invention solves the above-mentioned problems with the prior art printer. The present invention provides a printer that prevents occurrence of troubles such as damaging a recording medium inserted into the printer body due to inappropriate handling of the printer including inadvertent opening of a cover for an expendables receiving section that receives expendables used for printing by the printing mechanism, and inadvertent closing of the cover against the printer body, with the recording medium loaded into the printer body through the inlet provided in the printer cover, thereby achieving good printing on the recording medium.

In order to achieve the above object, the present invention provides a printer for printing information on a recording medium on which data is recordable, the printer comprising: a printing mechanism for printing information on the recording medium; a printer body containing the printing mechanism and having therein an opening through which printing expendables are exchangeably received within the printer body; a printer cover provided openable on the printer body to cover the opening, the printer cover having therein an inlet through which the recording medium is loaded into the printer body so as to appear partially outside the printer body; and inhibiting means for inhibiting the printer cover from being manually opened when the recording medium has been loaded into the printer body.

According to the inventive printer, the printer cover is inhibited from being manually opened when the recording medium has been loaded into the printer body. Thus, even when the printer cover is tried to be opened to load or exchange printing expendables in the receiving section in a state where the recording medium is inserted in the inlet in the printer cover, the cover opening is inhibited and the recording medium is protected from being damaged otherwise. In addition, the printing medium loaded within the printer body is protected from deviating from its reference print position and hence good printing is achieved.

The printer may comprise: engagement releasing means including an operation unit that is operated manually from outside the printer to release the engagement of the printer cover with the printer body performed by the engaging means, the inhibiting means comprising engagement release inhibiting means for inhibiting the operation of the engagement releasing means.

The release inhibiting means may comprise; an interlock mechanism that moves from an initial position thereof to a predetermined position thereof in conjunction with loading of the recording medium into the printer body and returns from the predetermined position thereof to the initial position thereof in conjunction with removal of the recording medium from the printer body; and operation stopping means for stopping operation of the operation unit in conjunction with movement of the interlock mechanism from its initial position to its predetermined position, and for releasing the stopping of the operation of the operation unit in conjunction with movement of the interlock mechanism from its predetermined position to its initial position.

The release inhibiting means may comprise: an interlock mechanism that moves from an initial position thereof to a predetermined position thereof in conjunction with loading of the recording medium into the printer body and returns from the predetermined position thereof to the initial position thereof in conjunction with removal of the recording medium from the printer body; and shielding means for shielding the operation unit in conjunction with the movement of the interlock means from its initial position to its predetermined position, thereby disabling manual operation of the operation unit and for releasing the shielding of the operation unit in conjunction with the returning operation of the interlock mechanism from its predetermined position to its initial position.

The engagement release inhibiting means may comprise: an interlock mechanism that moves from an initial position thereof to a predetermined position thereof in conjunction with the recording medium being loaded into the printer body and returns from its predetermined position to its initial position in conjunction with the recording medium being removed from the printer body; and cutoff means provided in the engagement releasing means for cutting off transmission of an operation force of the operation unit to the engaging means to invalidate the operation of the operation unit in conjunction with the interlock mechanism moving from its initial position to its predetermined position and for releasing the cutoff of the transmission of the operation force of the operation unit performed by the engagement releasing means to make the operation of the operation unit effective in conjunction with the interlock mechanism returning from its predetermined position to its initial position.

The engagement release inhibiting means may comprise: detecting means for detecting that the recording medium is loaded into the printer body; locking means movable between a locked position thereof where the operation unit is locked and an un locked position thereof where the operation unit is unlocked; drive means for moving the locking means between the locked and unlocked positions; and control means, responsive to the detecting means detecting that the recording medium is loaded in the printer body, for moving the locking means to the locked position and responsive to the detecting means detecting that no recording medium is loaded into the printer body, for moving the locking means to the unlocked position.

In the printer, the engagement release inhibiting means may comprise: an inlet cover for covering the inlet in the printer cover openably, the inlet cover being opened manually when the recording medium is loaded into the printer body; and locking means for preventing operation of the operation unit in conjunction with the opening of the inlet cover.

In the printer, the engagement release inhibiting means may comprise: an inlet cover provided on the printer cover for covering the inlet in the printer cover, the inlet cover being opened manually when the recording medium is loaded into the printer body; and cutoff means included in the engagement releasing means that interrupts transmission of an operation force by the operation unit to the engaging means to invalidate the operation of the operation unit in conjunction with the opening operation of the inlet cover.

In the printer, the inhibiting means may comprise: an interlock mechanism moving from an initial position thereof to a predetermined position thereof in conjunction with the recording medium being loaded into the printer body and returning from the predetermined position thereof to the initial position thereof in conjunction with the recording medium being removed from the printer body; and locking means for locking the printer cover in an unopenable manner to the printer body in conjunction with movement of the interlock mechanism from its initial position to its predetermined position, and for unlocking the cover from the printer body in conjunction with return of the interlock mechanism from its predetermined position to its initial position.

In the printer, the inhibiting means may comprise: detecting means for detecting that the recording medium is loaded into the printer body; locking means movable between a locked position thereof where the printer cover is locked to the printer body and an unlocked position thereof where the printer cover is unlocked from the printer body; drive means for moving the locking means between the locked and unlocked positions; and control means, responsive to the detecting means detecting that the recording medium is loaded in the printer body, for moving the locking means to the locked position and responsive to the detecting means detecting that no recording medium is loaded into the printer body, for moving the locking means to the unlocked position.

In the printer, the printing mechanism may comprise: conveying mean for conveying the recording medium, inserted into the inlet in the printer cover with a part of the recording medium appearing outside the printer body, along a conveyance path formed along the inlet within the printer body; and a printing head for printing on the recording medium conveyed by the conveying means.

BRIEF DESCRIPTION OF THE DRAWINGS

The accompanying drawings, which are incorporated in and constitute a part of the specification, illustrate presently preferred embodiments of the present invention and, together with the general description given above and the detailed description of the preferred embodiments given below, serve to explain the principles of the present invention in which.

DETAILED DESCRIPTION OF THE INVENTION

Figure 1:
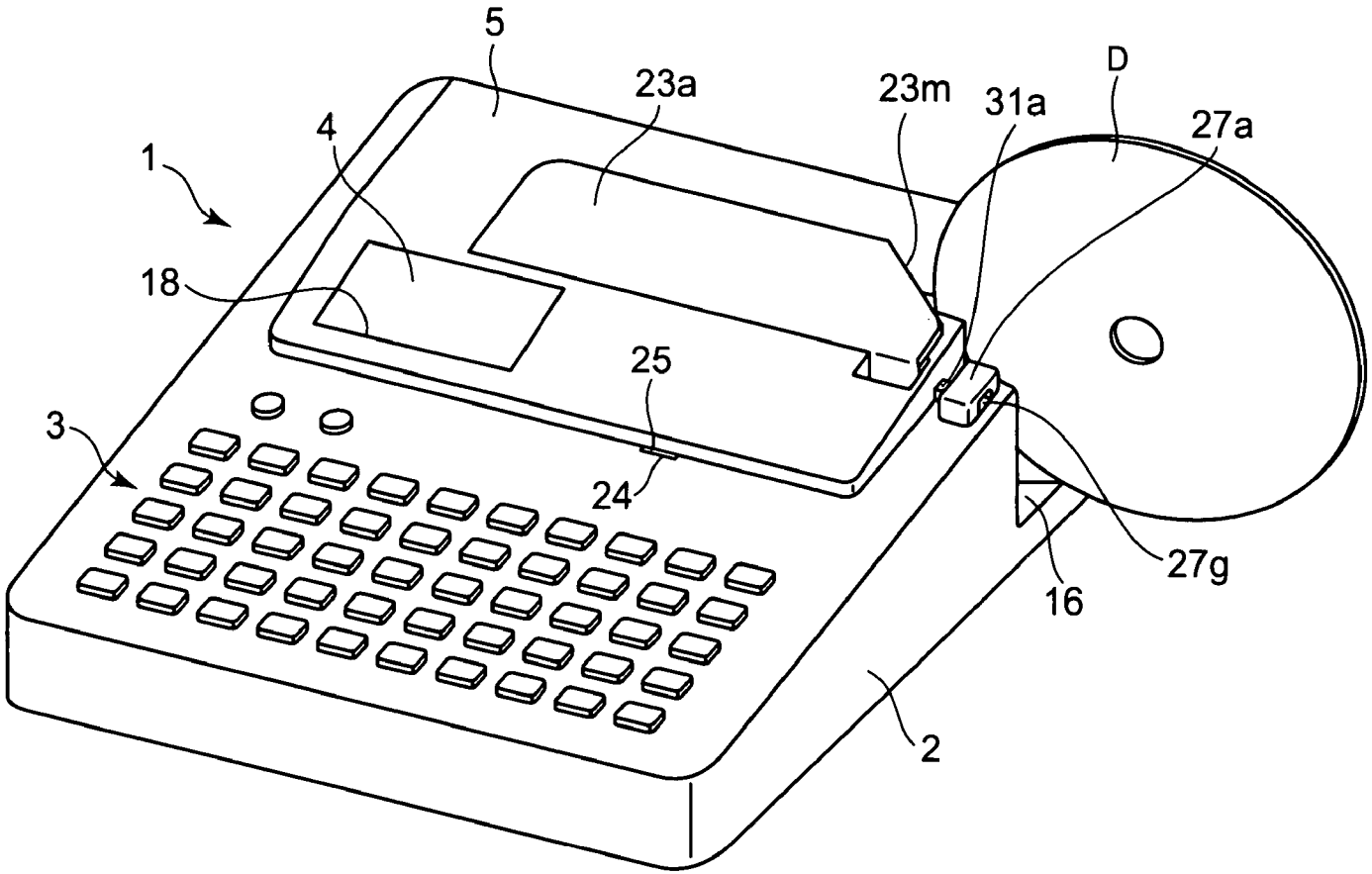
FIG. 1 is a perspective view of a first embodiment of a printer according to the present invention on which an optical disk is about to be loaded.
Figure 2:
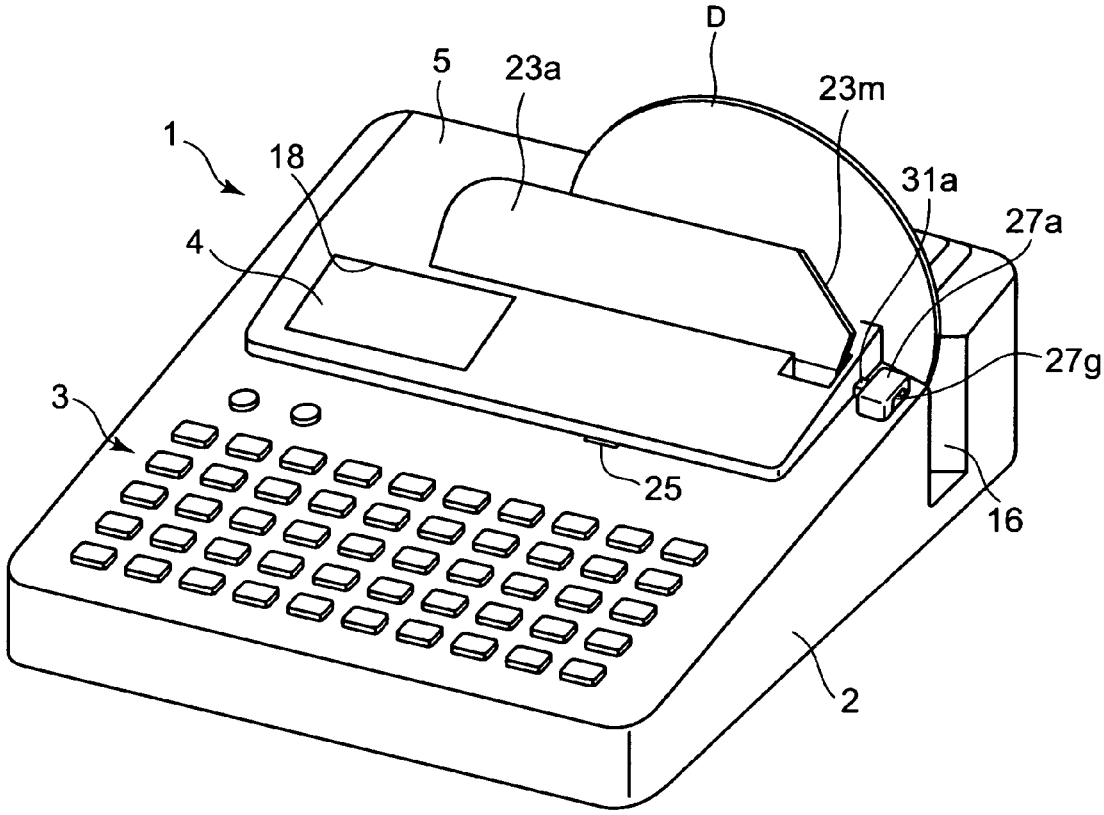
FIG. 2 is a perspective view of the printer into which the disk is loaded.
Figure 3:
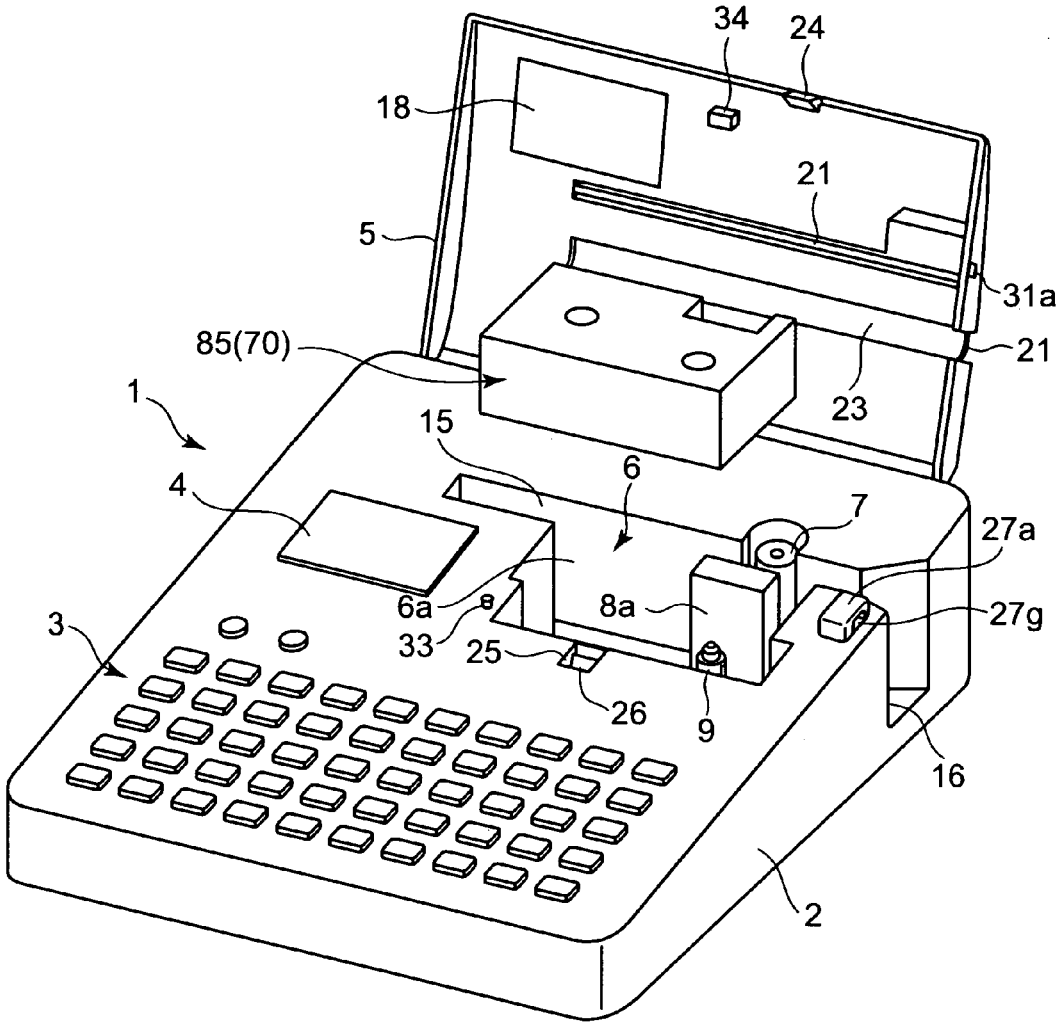
FIG. 3 is a perspective view of the printer with a cover open.
Figure 4:
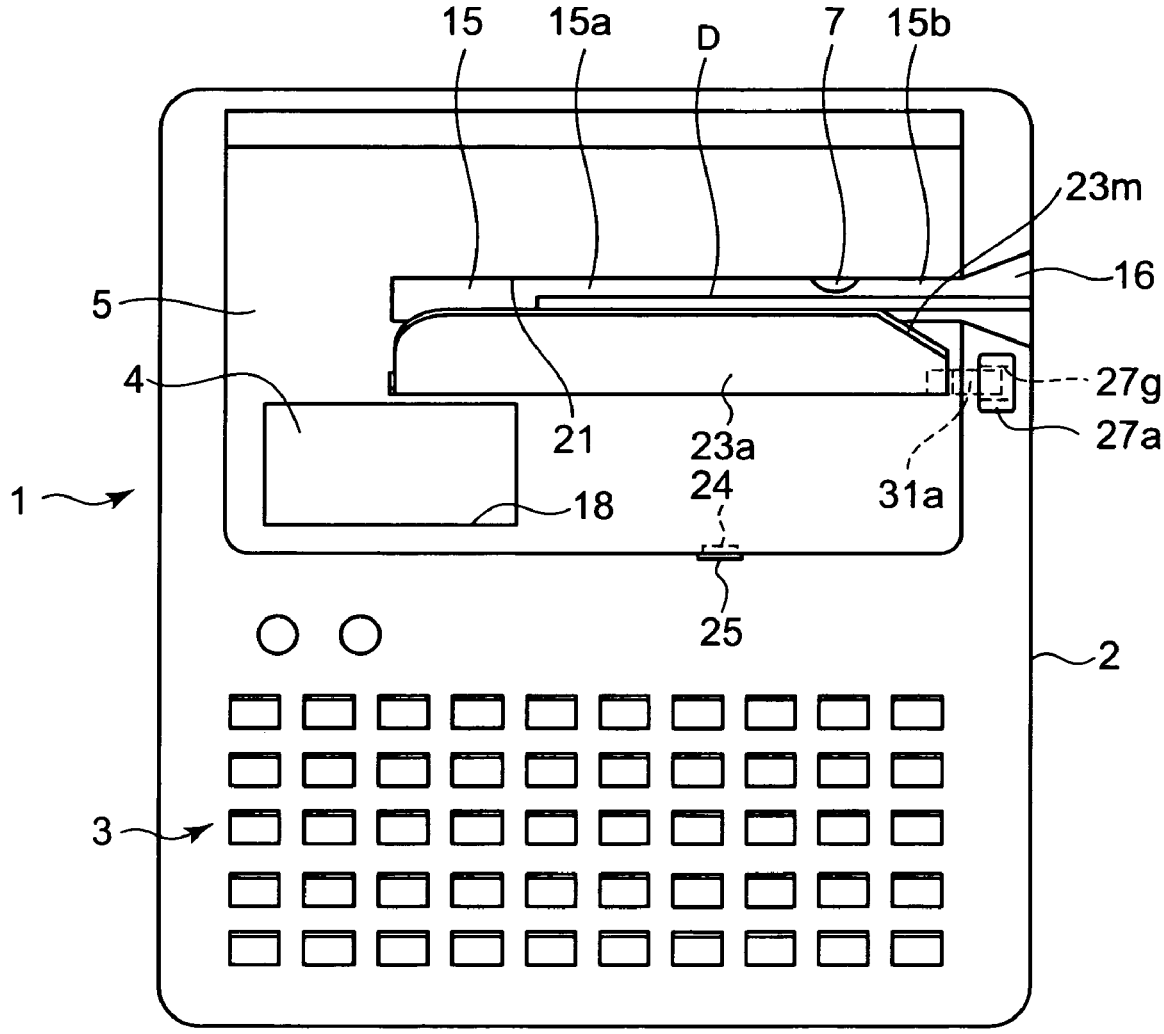
FIG. 4 is a plan view of the printer with the cover closed and the optical disk loaded into the printer.
Figure 5:
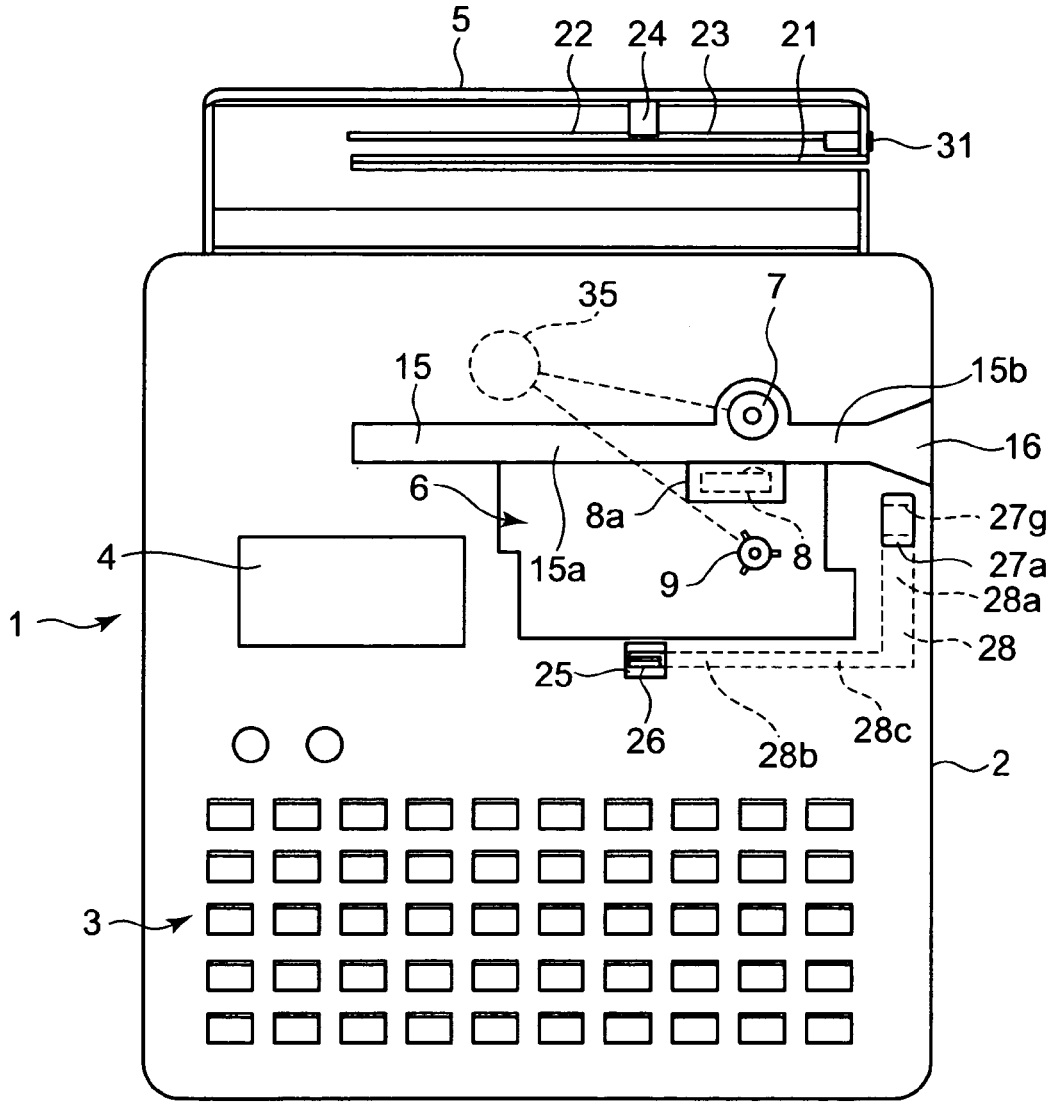
FIG. 5 is a plan view of the printer with the cover open.
Figure 6A:
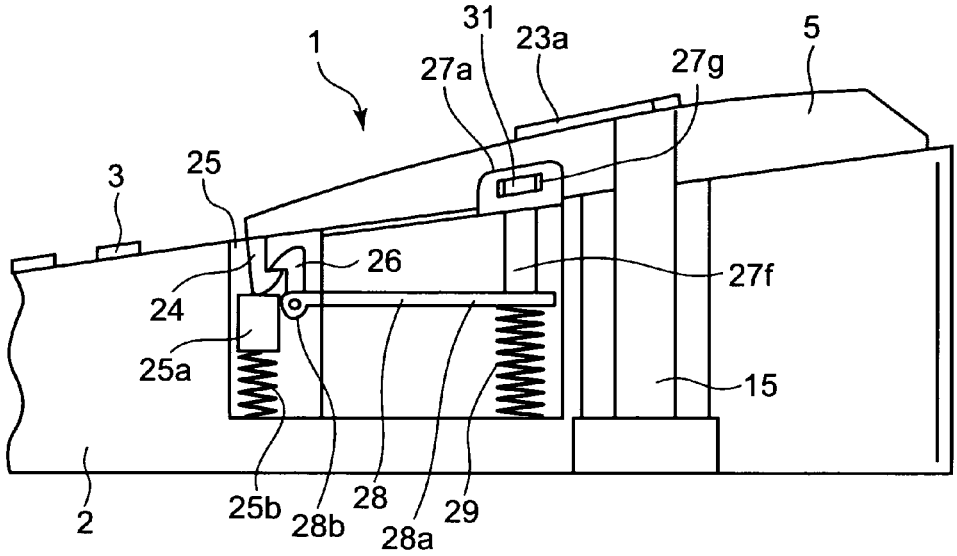
FIG. 6A illustrates the inner structure of a part of the printer.
Figure 6B:
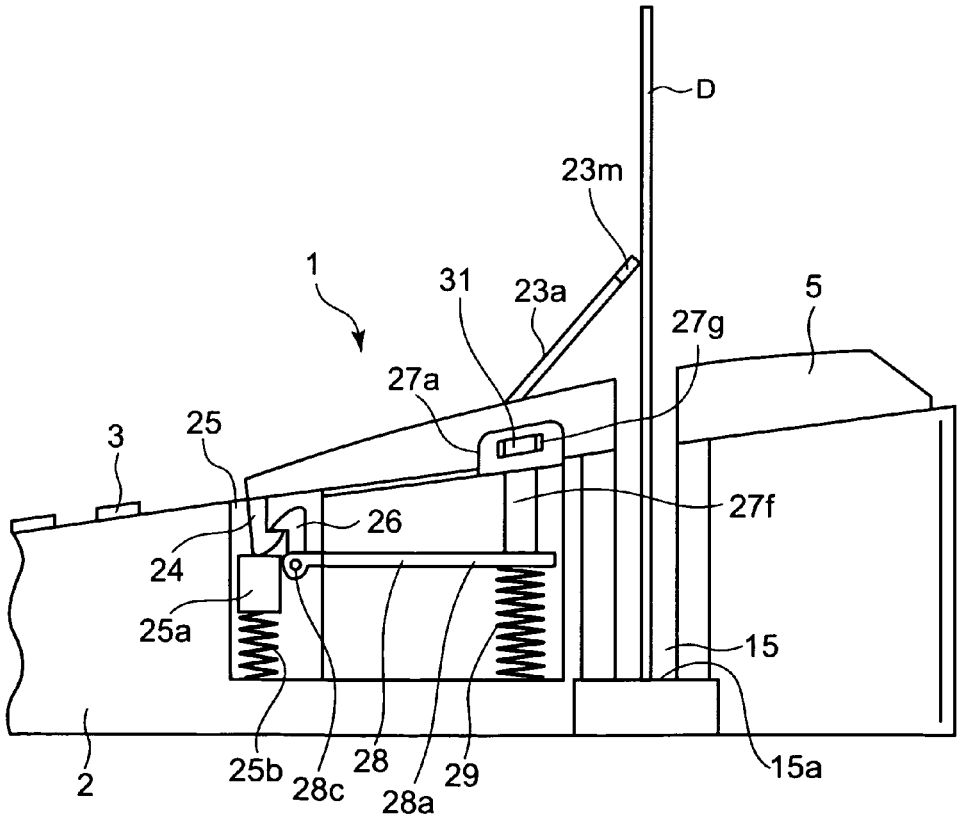
FIG. 6B illustrates the inner structure of the part of the printer into which the optical disk is loaded.

FIG. 1 is a perspective view of a first embodiment of a printer according to the present invention on which an optical disk is about to be loaded. FIG. 2 is a perspective view of the printer into which the disk is loaded. FIG. 3 is a perspective view of the printer with a cover open. FIG. 4 is a plan view of the printer with the cover closed and the optical disk loaded into the printer. FIG. 5 is a plan view of the printer with the cover open. FIG. 6A illustrates the inner structure of a part of the printer. FIG. 6B illustrates the inner structure of the part of the printer into which the optical disk is loaded.

The printer 1 is capable of directly printing on a printing (or label) surface of a disk-like recording medium (or optical disk) such as a CD-R (Compact Disk Recordable), a CD-RW (Compact Disk ReWritable), a DVD-R (Digital Versatile Disk Recordable) and also printing on a tape-like printing medium (or printing tape).

The printer 1 has a flat box-shaped body 2 whose height dimension is small compared to the width and length dimensions thereof. The body 2 has a front or upper surface inclined this way with a key-in unit 3 and a display 4 provided on the surface. The key-in unit 3 comprises character keys for inputting information on characters to be printed, a print key for giving a command to start printing, cursor keys for moving cursors on the display screen of the display 4, and control keys necessary for editing the inputted characters, and for performing various setting operations and a printing operation. The display 4 comprises a liquid crystal display that displays the inputted character information and information necessary for indicating the contents of the various processing operations.

The printer body 2 comprises a cartridge receiving section 6 in the form of a concavity that can receive a cartridge and an optical disk and has a cover 5 for covering an opening 6*a* for the cartridge receiving section 6.

Figure 9A:
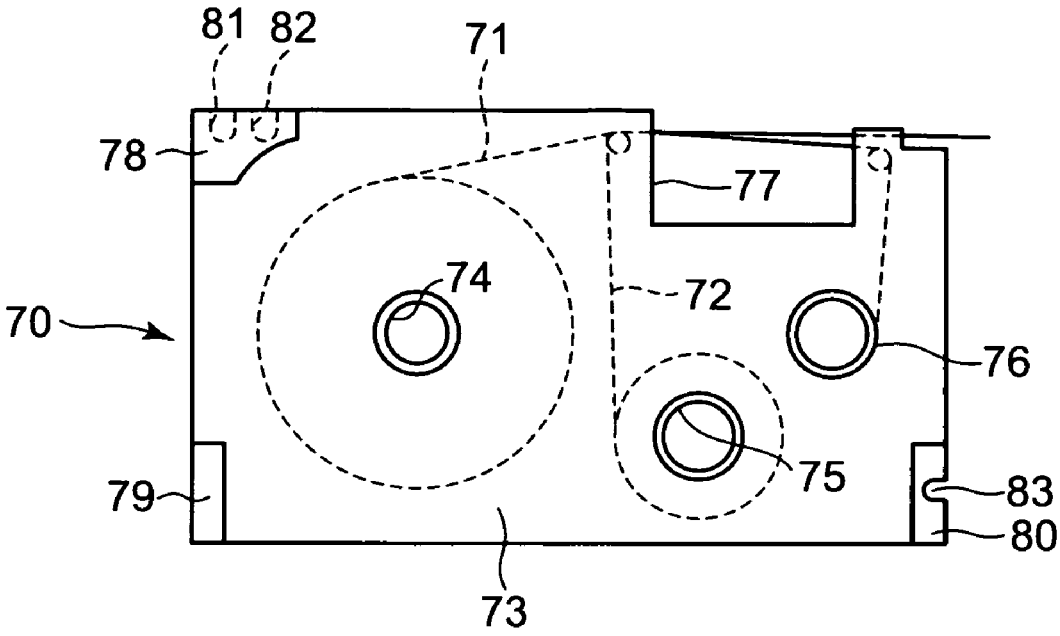
FIGS. 9A and 9B are plan and perspective views, respectively, of a tape cartridge for use with the printer.
Figure 9B:
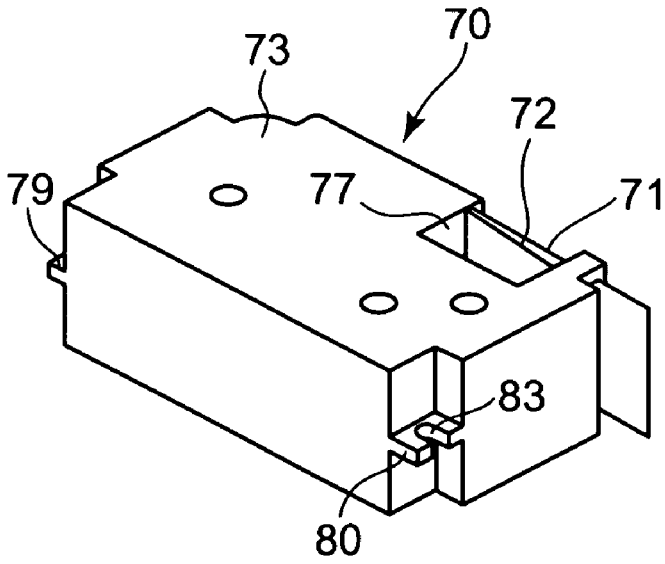
Figure 10A:
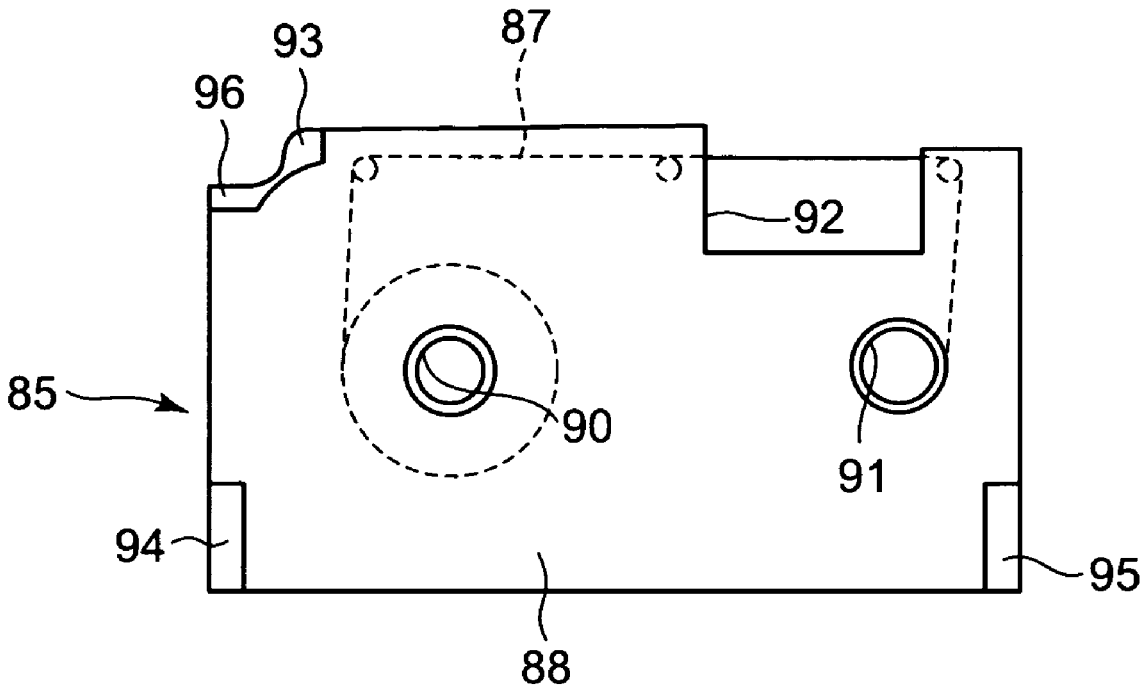
FIGS. 10A and 10B are plan and perspective views, respectively, of an ink cartridge for use with the printer.
Figure 10B:
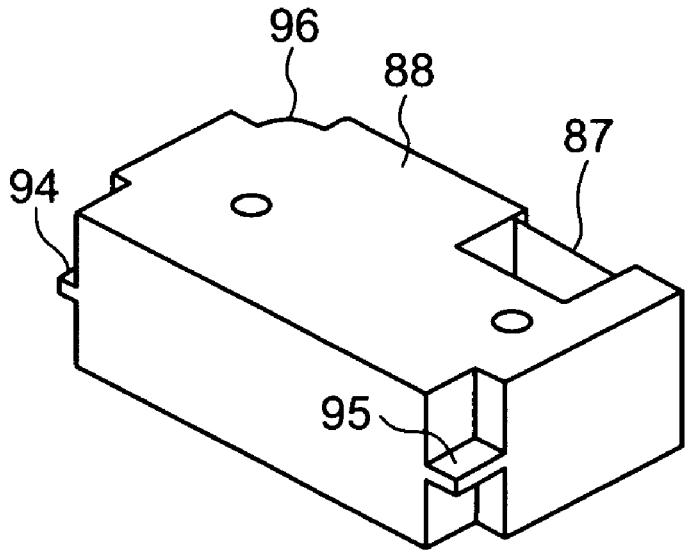

One of a tape cartridge 70 of FIGS. 9A and 9B and an ink cartridge 85 of FIGS. 10A and 10B is received as expendables for use in printing in the cartridge receiving section 6. The tape cartridge 70 contains a printing tape 71 as a printing medium and an ink ribbon 72 within a cartridge case 73. The ink cartridge 85 contains an ink ribbon 87 within a cartridge case 88.

Figure 11:
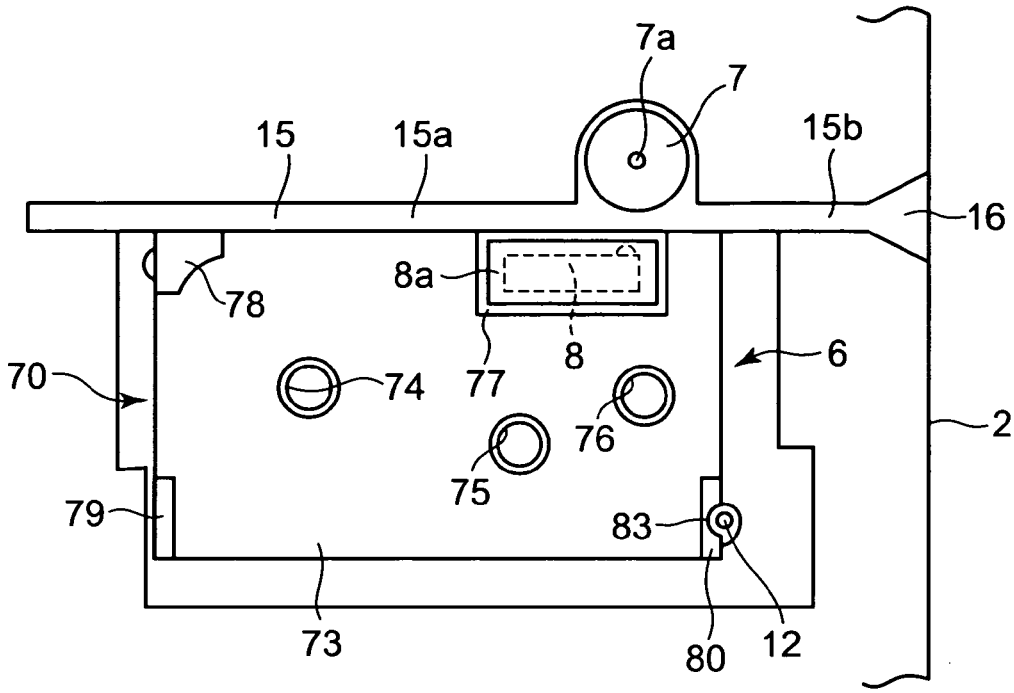
FIG. 11 is a plan view of the printer in which a tape cartridge is received within the cartridge receiving section.
Figure 12:
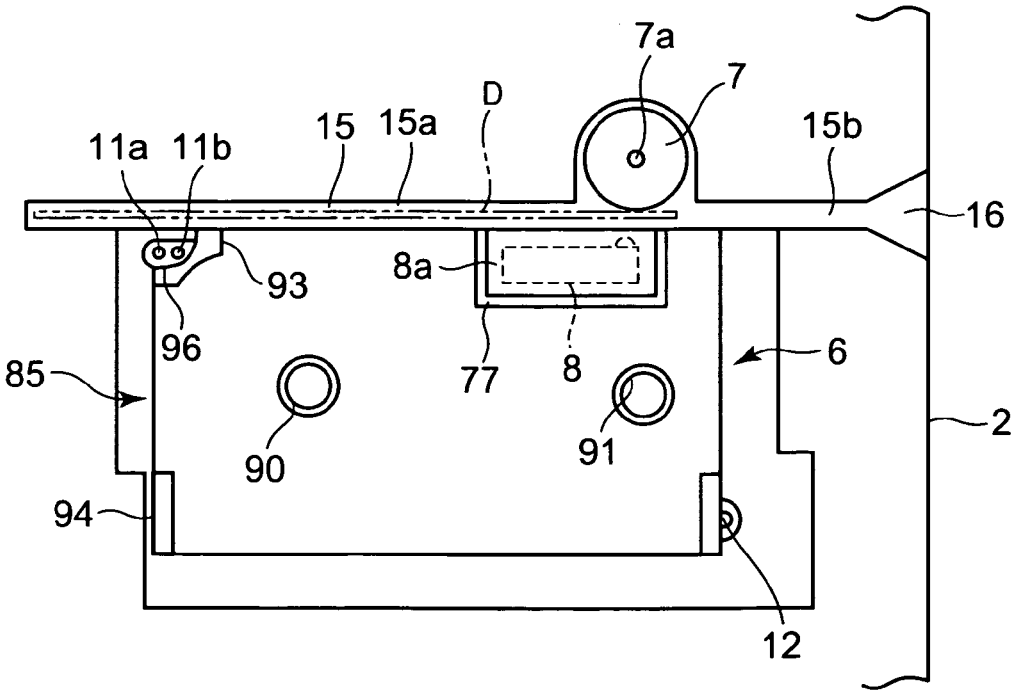
FIG. 12 is a plan view of the printer in which an ink cartridge is received within the cartridge receiving section.

When printing is performed on the printing tape 71, the tape cartridge 70 is received within the cartridge receiving section 6, as shown in FIG. 11. When printing is performed on the label surface of the optical disk D, the ink cartridge 85 and the optical disk D are loaded within the cartridge receiving section 6, as shown in FIG. 12. The tape and ink cartridges 70 and 85 are the same in outer shape. The optical disk D is loaded upstanding into the printer body 2, as shown in FIGS. 1 and 2.

A platen 7 and a printing head 8, which compose the printing mechanism, are provided in opposing relationship within the cartridge receiving section 6. Also, a ribbon winding shaft 9 is provided.

More particularly, the platen 7 has an upstanding shaft at a predetermined position within the cartridge receiving section 6 and is rotated by a motor 35 (FIG. 6). When the tape cartridge 70 is loaded into the cartridge receiving section 6, the rotating platen 7 cooperates with the thermal head 8 to downstream convey the printing tape 71 and the ink ribbon 72 of the tape cartridge 70 therebetween. When the ink cartridge 85 and the optical disk D are loaded into the cartridge receiving section 6, the rotating platen 7 cooperates with the thermal head 8 to downstream convey the ribbon 87 and the disk D therebetween. When the platen 7 is rotated, it functions as means for conveying an object to be printed.

The printing head 8 is composed of a thermal head provided opposite to the platen 7 within the cartridge receiving section 6. The thermal head 8 includes a cover 8*a* within which an upstanding printing element of heaters arranged in line is provided so as to move into contact with, or away from, the platen 7. When the tape cartridge 70 is loaded into the cartridge receiving section 6 and printing is started, an ink in the ink ribbon 72 is transferred thermally to the printing tape 71 conveyed by the platen 7. When the ink cartridge 85 is loaded into the cartridge receiving section 6 and printing is started, an ink in the ink ribbon 87 is transferred thermally to the optical disk D conveyed by the platen 7.

The ribbon winding shaft 9 is arranged to rewind therearound used parts of the ink ribbon 72 of the tape cartridge 70 and the ink ribbon 87 of the ink cartridge 85 in order to withdraw the used ribbon parts into within the cartridge cases 73 and 88, respectively.

In addition, as shown in FIG. 10 a plurality of supports 10*a*, 10*b* and 10*c* and an engaging element 10*e* are provided so as to engage with and support the tape cartridge 70 and the ink cartridge 85 at respective predetermined positions within the cartridge receiving section 6. In addition, a plurality of tape cartridge detection switches 11*a* and 1*b* to detect the presence and tape width dimension, respectively, of the tape cartridge 70, and an ink cartridge detection switch 12 to detect the presence of an ink cartridge 85 are provided within the cartridge receiving section 6. Also, provided within the cartridge receiving section 6 are a first disk sensor 13 that senses the presence of the optical disk D loaded at a predetermined position in the printer body 2 and a second disk sensor 14 that senses the presence of the optical disk D in the conveyance path 15, or in the printer body 2.

A conveyance path 15 is provided along a remote edge of the cartridge receiving section 6 so as to guide the optical disk D upstanding therealong between the platen 7 and the thermal head 8. The conveyance path 15 takes the form of a straight-line groove extending right and left from an upstream point on the printer body 2 somewhat close to the left side of the printer body 2 to the downstream opening 16 on the right side of the printer body 2. The conveyance path 15 has a guiding bottom 15*a* along which the optical disk D is guided between the platen 7 and the thermal head 8 with the lower end of the optical disk 7 in contact with the guiding groove bottom 15*a*.

The platen 7 and the thermal head 8 are disposed in opposing relationship at a predetermined position along the conveyance path 15 with the conveyance path 15 extending therebetween. The predetermined position composes a print position. A conveyance path for the printing tape 71 is composed of a part of the conveyance path 15 for the optical disk D extending from the vicinity of the printing position to the downstream opening 16.

Figure 8:
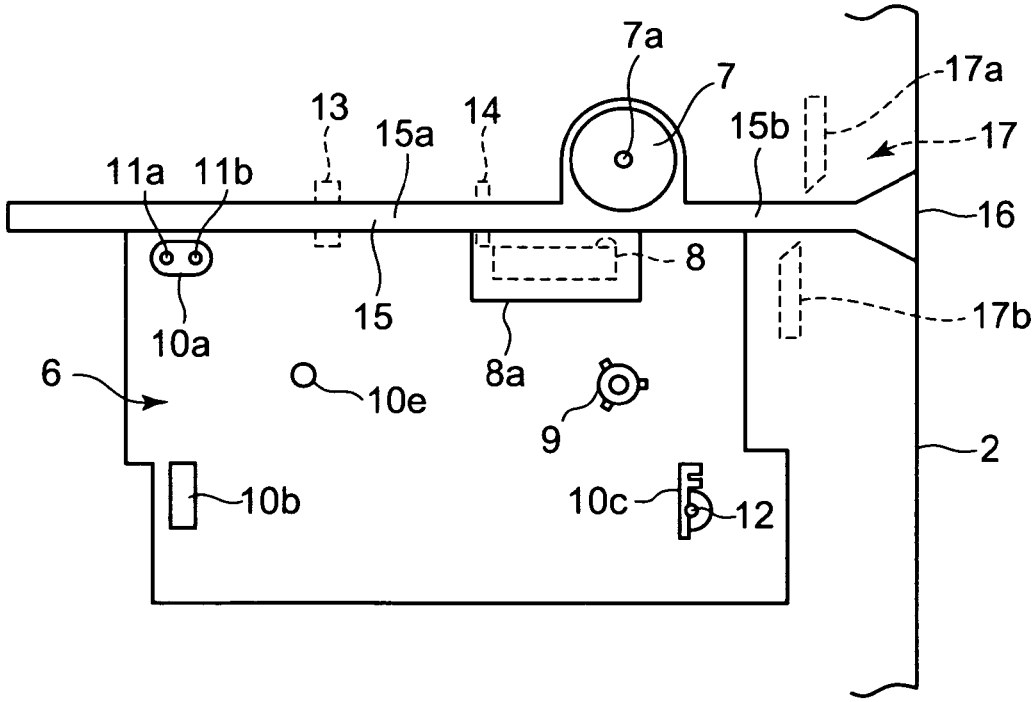
FIG. 8 is a plan view of a cartridge receiving section in the printer.

The printing tape 71 and optical disk D used and printed, respectively, within the printer body 2 are conveyed to the downstream opening 16 formed in the right-hand side of the printer body 2. As shown in FIG. 8, a cutting mechanism 17 is provided on the printer body 2 for cutting a used part of the tape 71 in the vicinity of the downstream opening 16. The cutting mechanism 17 comprises fixed and movable cutting blades 17*a* and 17*b* provided in opposing relationship such that the tape conveyance path 15 extends between the cutting blades. The fixed blade 17*a* is fixed to the printer body 2 and the movable blade 17*b* is provided so as to be moved against and away from the fixed blade 17*a*.

When a used part of the printing tape 71 of the tape cartridge 70 loaded in the cartridge receiving section 6 is discharged from the cartridge 70 through the opening 16 to the outside, the movable blade 17*b* is driven by the cutter motor 105, thereby moving against the fixed blade 17*a*, and cooperating with fixed blade 17*a* to cut the used part of the printing tape 71. Thereafter, the movable blade 17*b* is moved away from the fixed blade 17*a* and then stops at a standby position.

Figure 13A:
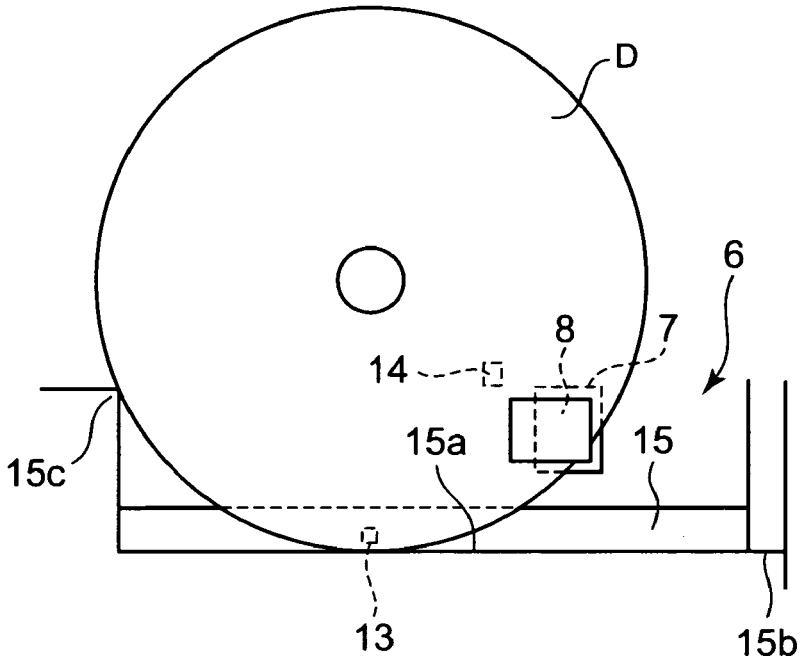
FIG. 13A illustrates an optical disk loaded at a setting position within the cartridge receiving section in the printer.
Figure 13B:
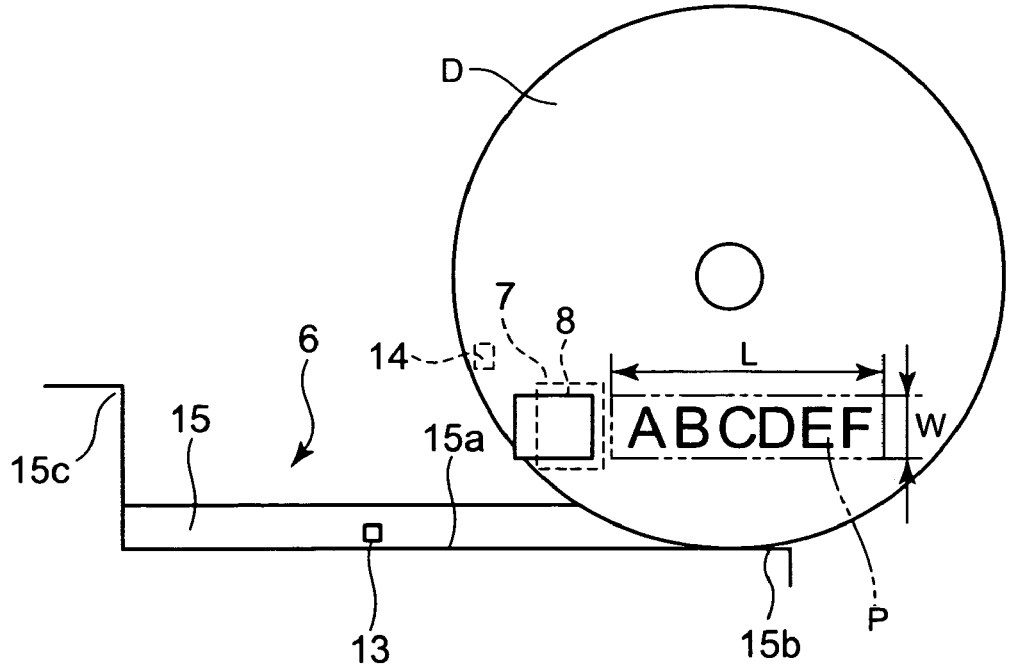
FIG. 13B illustrates a print on an optical disk loaded within the cartridge receiving section.

FIG. 13A shows the optical disk D loaded at a set position within the cartridge receiving section 6. FIG. 13B shows a print performed on the optical disk D loaded in the cartridge receiving section 6. As shown in FIGS. 13A and 13B, a positioning element 15*c* that stops the optical disk D loaded into the printer body 2 through the opening 16 and sets the disk at a predetermined position is provided at the upstream end of the conveyance path 15 provided within the printer body 2.

The disk sensor 13 is an optical transparent type one that comprises a light emitting element and a light detecting element that cooperate to sense that the optical disk D is set at the predetermined position within the cartridge receiving section 6 by sensing the lowest edge of the upstanding optical disk D at a predetermined position in the conveyance path 15. The disk sensor 14 is a reflective type one provided at a position downstream of the disk sensor 13 in the conveyance path 15 to sense the optical disk D conveyed from the set position of the sensor 14 to the discharge position of the disk. That is, the disk sensor 14 senses that the optical disk D is present in the conveyance path 15 or loaded in the printer body 2.

The openable cover 5 provided above the cartridge receiving section 6 is attached turnable to the upper surface of the printer body 2 through a hinge whose shaft extends through the width of the printer body 2 (in the right-left direction in FIG. 5) at the back of the printer body 2. A transparent window 18 is provided at a position on the cover 5 through which the display 4 and the cartridge receiving section 6 can be viewed externally. The cover 5 also has a slit-like disk inlet 21 therein extending in the width direction of the body 2 from a position in the vicinity of the transparent window 18 to the right end of the cover 5 open to the outside. When the cover is closed a0gainst the printer body 2, the inlet 21 is above and parallel to the conveyance path 15. The optical disk D is 1.2 mm thick and the disk inlet 21 is approximately 3-5 mm wide.

When the optical disk D is leftward inserted upstanding into the printer body 2 through the opening 16, it moves left along the conveyance path 15 and the inlet 21 and then reaches the set position in the cartridge receiving section 6. In this case, an upper half of the optical disk D appears above the printer body 2 at the inlet 21 in the cover 5.

In printing, the optical disk D is conveyed downstream along the conveyance path 15 in a state in which the optical disk D is inserted in the inlet 21 in the cover, and printed with required data during conveyance. The optical disk D then reaches its discharge end 15*b* adjacent to the path opening 16*b* where the printing ends. The user then uplifts and takes out the printed upstanding disk D at a stop at the discharge end 15*b* from the printer body 2.

In FIG. 13B, reference numeral P shows an area on a lower half of the optical disk D where data is printed. The area P has a width or height of W and a length of L where W corresponds to the whole length of the in-line arranged heaters of the thermal head 8 and L corresponds to a distance through which the thermal head 8 moves relative to the disk D in printing. A character string of "ABCDEF" appearing on the printed area P is simply as an example.

A strip-like inlet cover 23*a* is provided above the cover 5 which covers the cartridge receiving section 6 so as to extend through substantially the length of the slit-like inlet 21 in the cover 5. The inlet cover 23*a* is attached to the cover 5 so as to be turned around a pair of hinge axles 22 (see FIG. 7) each provided on a respective one of the right and left sides thereof in the vicinity of the key-in unit 3. Normally or when no optical disk D is loaded, the inlet cover 23*a* is turned so as to cover the inlet 21 in the cover 5 due to the weight thereof.

When the optical disk D is inserted upstanding into the conveyance path 15 (leftward in FIG. 1) through the opening 16, the optical disk D hits an inclined edge 23*m* formed on the opening 16 side outer corner of the inlet cover 23*a* at the leftmost or somewhat higher point on a leading peripheral part thereof. This causes the optical disk D to push and turn the inlet cover 23*a* upward around the pair of axles 22 so as to be upstanding, thereby opening the inlet 21.

Normally, the inlet cover 23*a* is lying flat so as to cover the inlet 21 in the cover 5. Thus, the optical disk D cannot be inserted upstanding from above through the inlet 21 into the printer body 2. When the tape cartridge 70 or the ink cartridge 85 is loaded into the cartridge receiving section 6 within the printer body 2, its ink ribbon 72 or 87 will be conveyed in the horizontal direction. On the other hand, when the optical disk D is inserted through the inlet 21 from above into the printer body 2, the direction in which the optical disk D is inserted is perpendicular to the direction in which the ink ribbon 72 or 87 extends. As a result, the ink ribbon may be twisted or damaged possibly. In order to avoid such trouble, the optical disk D is inserted into the printer body 2 in the horizontal direction in which the ink ribbon 72 or 87 extends.

The inlet cover 23*a* is made of a transparent material such that when the optical disk D is inserted upstanding into the printer body 2 leftward through the opening 16 with the label surface of the disk facing this way, the label surface of the disk can be viewed externally through the transparent inlet cover 23*a*. When the optical disk set at the predetermined position within the printer body 2 is turned such that a print such as a trade name printed beforehand on the label surface of the optical disk D becomes parallel to a horizontal edge of the inlet cover 23*a*, a character string to be printed becomes parallel in direction to the printed part.

As shown in FIGS. 3 and 6A, 6B, the cover 5 has a hook 24 at a free edge thereof or an opposite edge thereof from the hinges so as to enter a concavity 25 provided on the upper surface of the printer body 2 at a position coinciding with that of the hook 24 when the cover 5 is closed against the printer body 2. An engaging element 26 is provided within the concavity 25 such that when the hook 24 enters the concavity 25, the engaging element 26 engages with the hook 24 to maintain the cover 5 in a closed state. As shown in FIGS. 6A and 6B, an uplift mechanism is provided within the concavity 25 for uplifting the cover 5 on its free edge side by a predetermined distance when the hook 24 is disengaged from the engaging element 26. The uplift mechanism comprises an uplift member 25*a* movable vertically and engaged by the hook 24 of the cover 5 entering the concavity 25, and a spring 25*b* biasing the uplift member 25*a* upward resiliently. When the cover 5 is closed against the printer body 2 and the hook 24 of the cover 5 is engaged with the engaging member 26 provided in the printer body 2, the uplift member 25*a* is pressed down by the hook 24 of the cover 5, thereby compressing the spring 25*b*. When the hook 24 of the cover 5 is released from the engaging member 26 in the printer body 2, the uplift member 25*a* is uplifted by the resiliency of the compressed spring 25*b*, thereby uplifting the cover 5 on its free end side by a predetermined distance.

An operation button 27*a* as operation means is provided on the upper surface of the printer body 2 so as to be sinkable and protrudable relative to the upper surface of the printer body 2. The operation button 27*a* has an integral operation shaft 27*f* extending downward within the printer body 2. A connection lever 28 is provided connecting the engaging member 26 and a lower end of the operation shaft 27*f* together. A spring 29 is provided between a lower end of the operation shaft 27*f* and the bottom of the cartridge receiving section 6 for resiliently biasing the operation button 27*a* upward so as to protrude to a predetermined height upward from the upper surface of the printer body 2. The connection lever 28 abuts at one end 28*a* on the lower end of the operation shaft 27*f* so as to be connected to the operation button 27*a* and has the engaging member 26 at the other end 28*b* thereof. The connection lever 28 is rotatable around a pivot 28*c*.

When the user presses the operation button 27*a* downward against the resiliency of the spring 29, the operation shaft 27*f* moves downward along with the operation button 27*a* and turns the connection lever 28 clockwise around the pivot 28*c* in FIG. 6A. The engaging member 26 is attached at 28*c* to the left end of the connection lever 28. Thus, the engaging member 26 is turned clockwise along with the pivot 28*c* of the connection lever 28, thereby disengaging the engaging member 26 from the hook 24 and hence the cover 5, thereby rendering the cover 5 manually openable. When the cover 5 is disengaged, the cover 5 is somewhat uplifted on its free end side by the uplift mechanism to render the cover 5 openable further easily.

Figure 7:
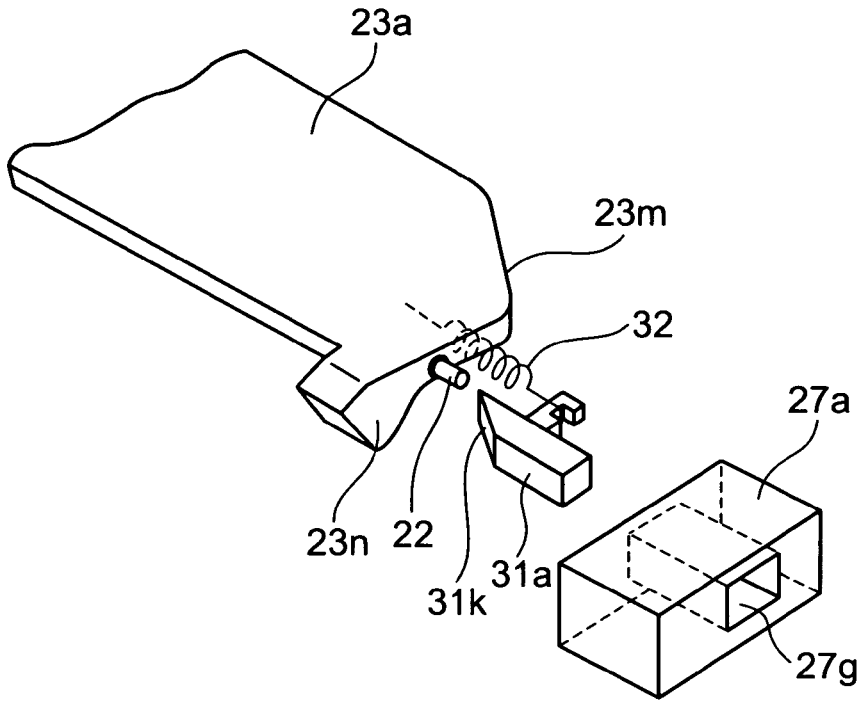
FIG. 7 is a perspective view of means that inhibits a release of engagement of the printer cover.

The cover 5 has a lock member 31*a* insertable as operation preventing means through a relevant side thereof outward into a hole 27*g*, which is provided in the operation button 27*a*, in conjunction with the turning operation of the inlet cover 23*a* as shown in FIG. 4. As shown in FIG. 7, the lock member 31*a* has an inclined edge 31*k* at a rear end thereof. A return spring 32*a* is provided between the lock member 31*a* and the cover 5. The inlet cover 23*a* has an inclined sliding edge 23*n* in the vicinity of the right hinge axle 22 provided on the lock member side of the inlet cover 23*a*. When the inlet cover 23*a* is turned toward its open position, the sliding edge 23*n* slides on the inclined edge 31*k* of the lock member 31*a*, thereby moving the lock member 31*a* into the through hole 27*g* in the operation button 27*a*.

When the optical disk D is loaded into the printer body 2 with the cover 5 closed against the upper surface of the printer body 2, the inlet cover 23*a* provided on the printer cover 5 is pushed by the optical disk D and turned upward around the pair of hinge axles 22 so as to be upstanding. In conjunction with this operation, the lock member 31*a* protrudes outward from the right side of the cover 5 and enters the through hole 27*g* in the operation button 27*a*, thereby preventing the operation button 27*a* from being pressed downward. When the optical disk D is removed from the printer body 2, the inlet cover 23*a* is turned downward around the pair of axles 22 due to the weight thereof, thereby releasing the pressing operation of the sliding edge 23*n* against the lock member 31*a*. Thus, the lock member 31*a* moves away from the through hole 27*g* in the operation button 27 under the action of the return spring 32 and then returns to the initial position thereof. This allows the operation button 27 to be moved downward.

As shown in FIG. 3, a cover switch 33 is provided on the printer body 2 to detect whether or not the cover 5 is closed against the printer body 2. A switch pusher 34 is provided at an appropriate position on the back of the cover 5 to push the cover switch 33 when the cover 5 is completely closed against the printer body 2.

Referring to FIGS. 9 and 10, the tape cartridge 70 and the ink cartridge 85 to be loaded into the cartridge receiving section 6 will be described furthermore. As shown in FIGS. 9A and 9B, the tape cartridge 70 comprises a cartridge case 73 which contains a roll of printing tape 71 with a core 74, a roll of unused ink ribbon 72 with a core 75, and a hollow ribbon winding core 76 to rewind a used ink ribbon therearound.

The cartridge case 73 has a concavity 77 formed on a side thereof into which the thermal head will be inserted. When the printing tape 71 and the ribbon core 72 are fed into the concavity 77, the ink ribbon 72 used for printing is rewound by the hollow winding core 76 and then returns into the cartridge case 73.

The tape cartridge case 73 has supported corners 78, 79 and 80 that will be supported by corresponding supports 10*a*, 10*b* and 10*c* (see FIG. 8) provided within the cartridge receiving section 6. In order to detect the type of tape cartridge case loaded, the supported corner 78 has therein one or none of cutouts 81 and 82 shown by broken lines in FIG. 9A. That is, herein, there are three different types of supported corners i.e., one with a cutout 81, one with a cutout 82, and one with none of them. For example, if a tape cartridge case having a supported corner 78 with the cutout 81 is loaded into the cartridge receiving section 6, the switch 11*a* provided within the receiving section 6 is received within the cutout 81 and is not turned on. However, when the supported corner 78 has no cutout to receive the switch 11*b*, the supported corner 78 hits and turns on the switch 11*b*. This implies that if a cutout different depending on the type of tape cartridge case is provided in the supported corner of the tape cartridge case, the type of tape cartridge case loaded can be determined or detected depending on which or none of the cutouts is present in the supported corner 78 of the cartridge case. The supported part 80 has a cutout 83 corresponding to the ink cartridge detection switch 12.

As shown in FIGS. 10A and 10B, the ink cartridge 85 has a cartridge case 88 which contains a roll of unused ink ribbon 87 with a core 90, and a hollow ribbon winding core 91 around which a used ink ribbon part 87 should be wound.

The cartridge case 88 has a concavity 92 provided on a relevant side thereof into which the thermal head 8 will be inserted. The ink ribbon 87 is fed from the cartridge case 88 into the concavity 92 and a used ink ribbon part is then wound by the winding core 91 within the cartridge case 88 while returning into the case 88.

The ink cartridge case 88 has supported corners 93, 94 and 95 corresponding to the supports 10*a*, 10*b* and 10*c*, respectively. The supported part 93 has a cutout 96 corresponding to tape cartridge detection switches 11*a* and 11*b* to maintain these switches in an off state. A supported part 95 corresponding to the ink cartridge detection switch 12 has no cutout, thereby turning on the switch 12 when the associated ink cartridge is loaded into the cartridge receiving section 6.

When the tape cartridge 70 is loaded into the cartridge receiving section 6 within the printer 1, the thermal head 8 is disposed in the concavity 77 in the cartridge case 73. Simultaneously, the ribbon winding shaft 9 is fitted into the hollow ribbon winding core 76. When the ink cartridge 85 is loaded into the cartridge receiving section 6 within the printer body 2, the thermal head 8 is disposed within the concavity 92 in the cartridge case 88, and the hollow ribbon winding shaft 9 is inserted into the ribbon winding core 91.

Referring to FIGS. 14-19, a printing mechanism will be described which is provided within the printer body 2. The printing mechanism moves the thermal head 8 to the printing position and non-printing position, carries the printing tape 71, the ink ribbons 72, 87 and the optical disk D, winds the ink ribbons 72 and 87, and then eliminates slacks on the ink ribbon 87.

Reference numeral 35 denotes the single printing motor as a drive source; 36 an output gear of the motor 35; 37-40 first-fourth deceleration gears; 41 a first sun gear; 42 a first planetary gear; 43 a second planetary gear; 45 a cam gear with a slot 46 therein and first and second toothless parts 47 and 48 provided at different positions on the periphery thereof in the thickness and periphery directions thereof. Reference numeral 49 denotes a lag gear mechanism that comprises three lag gears 49*a*, 49*b* and 49*c*, as shown FIG. 19, such that a lag function is performed between the gears 49*a* and 49*b* and between the gears 49*a* and 49*c*. Reference numeral 50 denotes a one-way gear that transmits a drive force only in one direction; 51, 52 platen gears provided coaxially with the platen 7; 53 a second planetary gear; 54 a third planetary gear; 55 an intermediate gear; 56 a third sun gear; 57 a fourth planetary gear; and 58 a ribbon winding gear provided coaxially with the ribbon winding shaft 9.

The output gear 36 of the printing motor 35 meshes with the first sun gear 41 through the first-fourth deceleration gears 37-40. The first and second planetary gears 42 and 43 are disposed at the periphery of the sun gear 41 so as to mesh with the sun gear 41. The first and second planetary gears 42 and 43 are disposed at the same levels as the first and second toothless parts 47 and 48, respectively, of the cam gear 45, and supported against the sun gear 41 so as to be meshable with the cam gear 45. The first sun gear 41 meshes with the lag gear 49*a* of the lag gear mechanism 49. One of the lag gears 49*b* and 49*c*, rotating with a predetermined lag from rotation of the lag gear 49*a*, meshes with the one-way gear 50 and the other meshes with the intermediate gear 55. The platen gear 51 coaxial with the platen 7 meshes with the one-way gear 50. The other platen gear 52 meshes with the second sun gear 53. The intermediate gear 55 meshes with the third sun gear 56. The third planetary gear 54 meshes with the second sun gear 53 so as to be turnable around the sun gear 53. The fourth planetary gear 57 meshes with the third sun gear 56 so as to be turnable around the sun gear 56. The third and fourth planetary gears 54 and 57 are arranged to mesh with the ribbon winding gear 58 as they turns around the sun gear 53 and 56, respectively.

Reference numeral 59 denotes an L-shaped head arm pivoted at 62 on an end of a rightward extending branch of which arm the thermal head 8 is held. The head arm 59 has a pin 60 provided at a vertex of a triangular protrusion 59*a* extending from a cam-gear side edge of the other branch of the L-shaped head arm 59 for engaging in the cam slot 46 in the cam gear 45. The head arm 59 is biased resiliently at an end of the other branch of the head arm by a pull spring 61 so as to turn clockwise around the pivot 62. As the cam gear 45 rotates, the pin 60 slides along the inner edge of the slot 46 in the cam 45, thereby causing the head arm 59 to turn around the pivot 62.

Figure 14:
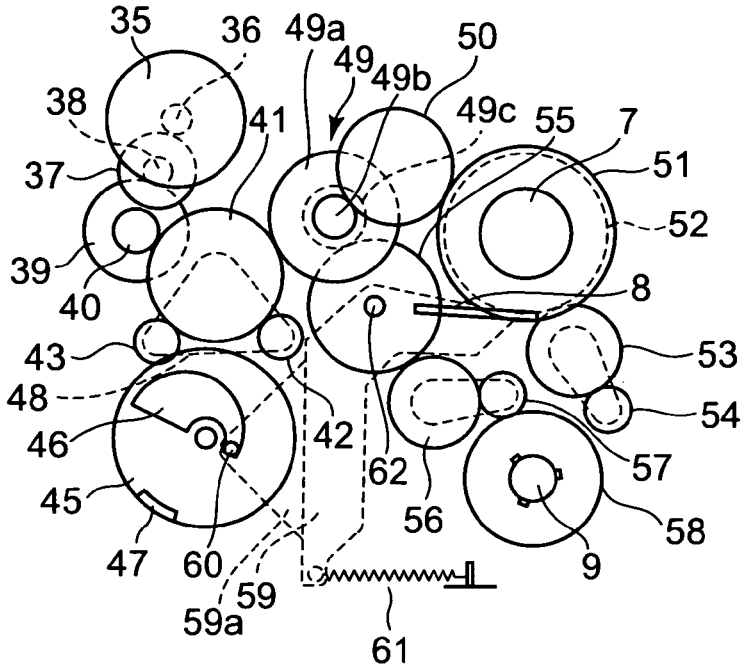
FIG. 14 illustrates a printing mechanism of the printer.

FIG. 14 shows an initial state of the printer immediately before printing starts. In this state, as shown the thermal head 8 is separated from the platen 7.

Figure 15:
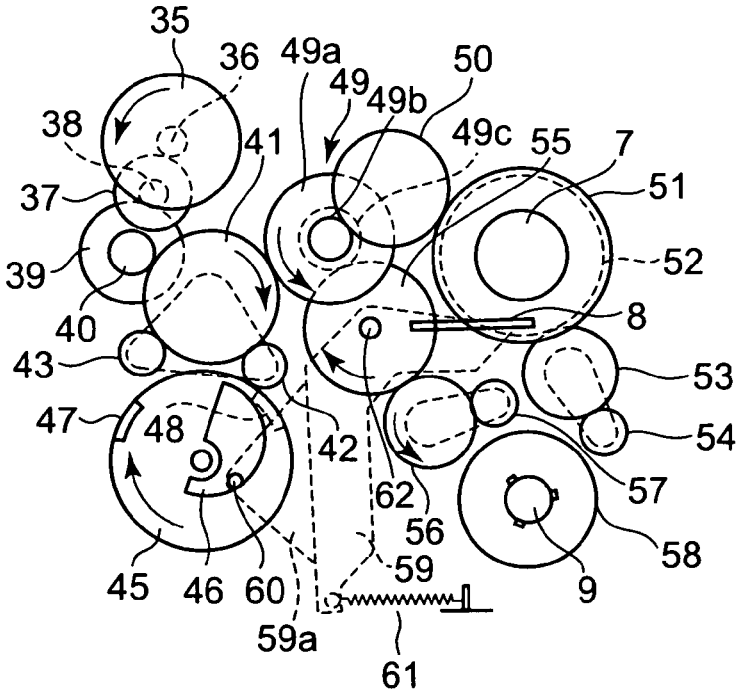
FIG. 15 illustrates the printing mechanism in a first stage of operation.

FIG. 15 shows the state of the printer immediately after the printing motor 35 started to operate in accordance with a command to start printing. When the printing motor 35 rotates in the forward direction shown by an arrow, the drive force of the motor is transmitted through the gears 36-40, the first sun gear 41, and the first planetary gear 42 to the sum gear 45, which is then turned clockwise. This causes the pin 60 to move along the inner edge of the cam slot 46, thereby causing the head arm 59 to turn counterclockwise around the pivot 62 by the resilience of the pull spring 61 and then causing the thermal head 8 to move toward the platen 7. The drive force of the printing motor 35 is transmitted through the gears 36-40 and the first sun gear 41 to the lag gear 49*a* of the lag gear mechanism 49. At this time, a lag function is performed between the lag gear 49*a* and the lag 49*b* and hence the lag gear 49*b* does not rotate. While the lag gear 49*b* meshes with the platen gear 51 through the one-way gear 50, no drive force is transmitted to the platen 7 because the lag gear 49*b* does not rotate. At this time, no lag function is performed between the lag gears 49*a* and 49*c*. Thus, although the drive force of the first sun gear 41 is transmitted through the intermediate gear 55 to the third sun gear 56, the ribbon winding shaft 9 is not driven because the fourth planetary gear 57 is separated from the ribbon winding gear 58. As just described above, during movement of the thermal head 8 toward the platen 7, neither the platen 7 nor the ribbon winding shaft 9 is driven.

Figure 16:
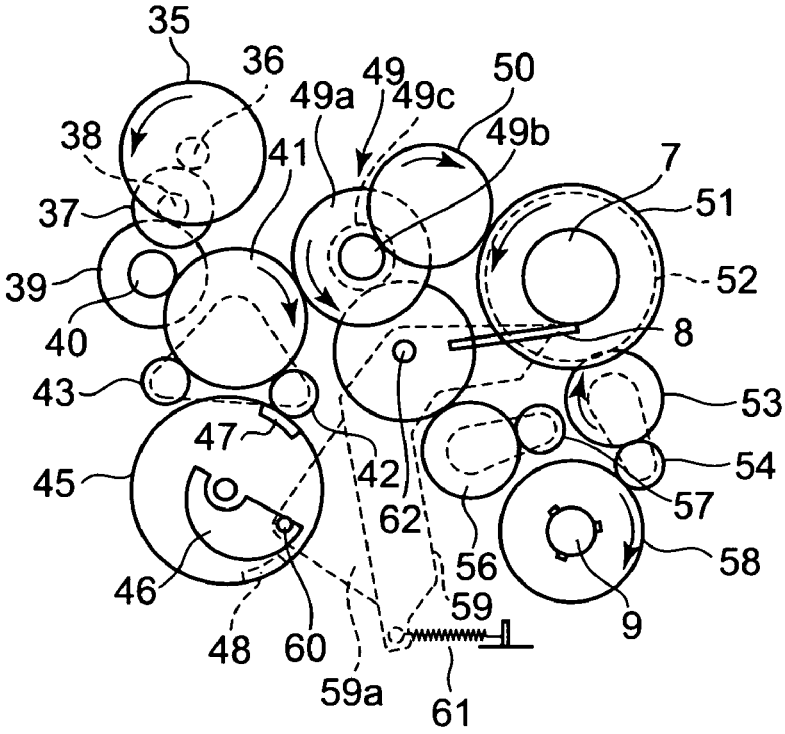
FIG. 16 illustrates the printing mechanism in a second stage of operation.

FIG. 16 shows a state in which the thermal head 8 is pressed against the platen 7. Printing will start in this state. At this time, as shown, the cam gear 45 rotates, which causes the first planetary gear 42 to fall into the first toothless part 47 of the sum gear 45. Thus, transmission of the drive force of the motor 35 to the cam gear 45 is interrupted, the rotation of the cam gear 45 stops, and the thermal head 8 is held pressed against the platen 7. On the other hand, at this time a lag duration between the lag gears 49*a* and 49*b* ends and the drive force of the motor 35 is transmitted to the platen gear 51 through the one-way gear 50, thereby driving the platen 7. Furthermore, the second sun gear 53 and the third planetary gear 54 are driven through the platen gear 52, and the third planetary gear 54 is caused to mesh with the ribbon winding gear 58, which causes the drive force to be transmitted to the ribbon winding shaft 9, thereby rotating the same.

Figure 17:
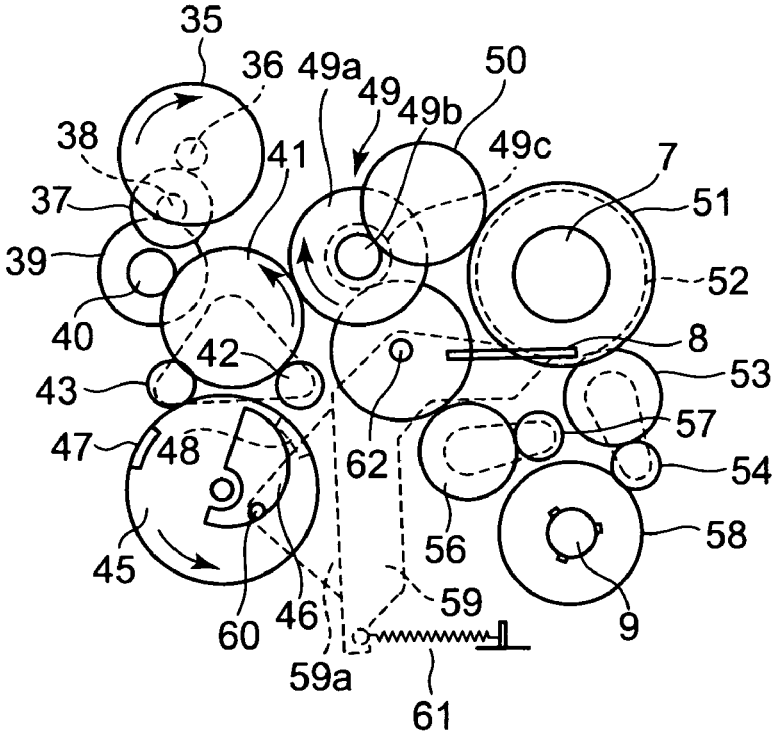
FIG. 17 illustrates the printing mechanism in a third stage of operation.

FIG. 17 shows a state in which the printing ends and the thermal head 8 is moved away from the platen 7, thereby releasing the pressing state of the thermal head 8. When the printing ends, the operation motor 35 is driven in the reverse direction. Thus, the first sun gear 41 is rotated counterclockwise, the first planetary gear 42 is moved away from the first toothless part 47 of the cam gear 45 and the second planetary gear 43 is caused to mesh with the cam gear 45. This causes the drive force of the motor 35 to be transmitted to the cam gear 45, which is then turned clockwise from the state of FIG. 16. This causes the head arm 59 to turn clockwise, thereby causing the thermal head 8 to move away from the platen 7. When the printing motor 35 is rotated in the forward direction, the one-way gear 50 rotates clockwise, thereby transmitting the drive force of the motor 35 to the platen gear 51. On the other hand, when the motor 35 is rotated in the reverse direction, transmission of its drive force is interrupted and hence the platen 7 does not rotate. At this time, although the lag gear 49*a* of the lag gear mechanism 49 is rotated in conjunction with the first sun gear 41, the lag function acts between the lag gears 49*a* and 49*c*. Thus, none of the intermediate gear 55 and the third sun gear 56 rotates. At this time, the fourth planetary gear 57 is separated from the ribbon gear 58 and no drive force is transmitted to the ribbon winding shaft 9.

Figure 18:
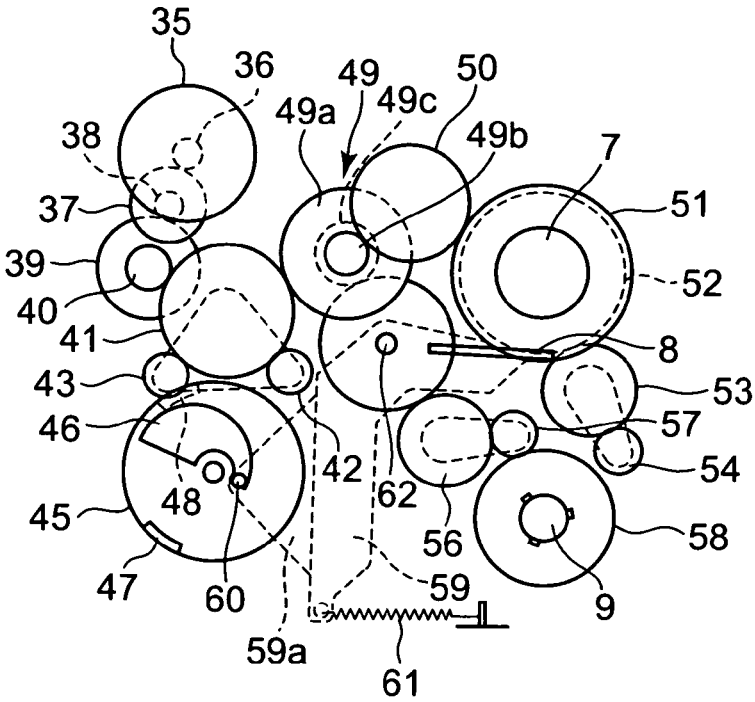
FIG. 18 illustrates the printing mechanism in a fourth stage of operation.
Figure 19:
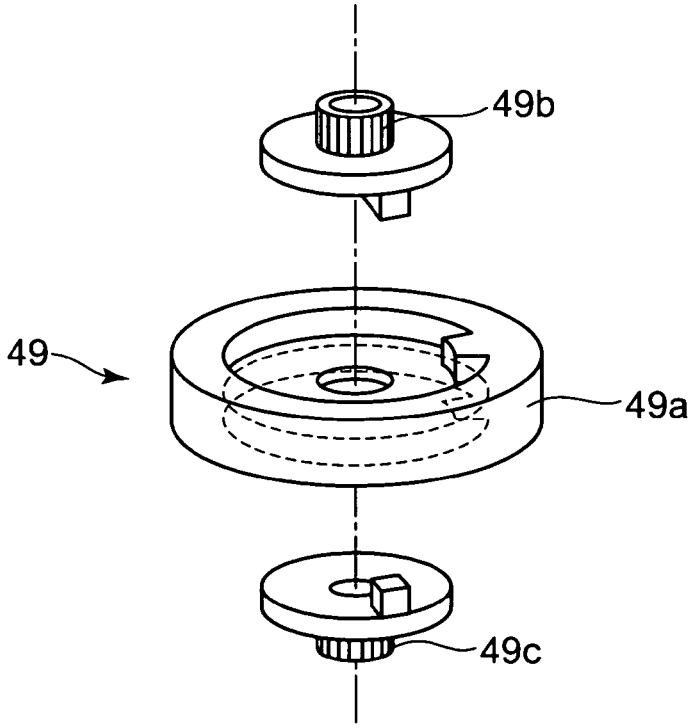
FIG. 19 illustrates a lag gear mechanism of the printing mechanism.

FIG. 18 shows a process for eliminating possible slacks in the ink ribbon after the thermal head 8 is moved away from the platen 7. After the thermal head 8 has moved away from the platen 7, the counterclockwise rotation of the cam gear 45 proceeds and the second planetary gear 43 falls into the second toothless part 48 in the cam gear 45. This stops the rotation of the cam gear 45, thereby maintaining the separation of the thermal head 8 from the platen 7. At this time, the lag function to be performed between the lag gears 49*a* and 49*c* is disabled. Thus, a drive force is transmitted from the lag gear 49*a* to the intermediate gear 55 and the sun gear 56, thereby causing the fourth planetary gear 57 to mesh with the ribbon winding gear 58 and hence driving the ribbon winding shaft 9 in the winding direction. This causes the ink ribbon slackened due to the movement of the thermal head 8 away from the platen 7 to be wound and the possible slacks are eliminated. This slack removing operation is performed by driving the printing motor 35 in the reverse direction only for a predetermined time after the printing ends and the thermal head 8 is separated from the platen 7. As described above, the printing is performed by driving the single printing motor 35, thereby repeating the operations shown in FIGS. 14-18.

Next, a process for printing information such as a title on the label surface of the optical disk D will be described. It is assumed that when the upper surface of the printer body 2 is closed with the cover and the inlet 21 in the cover 5 is in turn covered with the inlet cover 23*a*, the operation button 27*a* is pushed manually downward against the resiliency of the spring 29. This causes the engaging element 26 to turn around the pivot 28*c*, thereby disengaging the engaging element 26 from the hook 24 of the cover 5. Thus, the engagement of the cover 5 with the printer body 2 is released and the cover 5 is uplifted on its free end side and the hook 24 is moved away from the concavity 25, thereby causing the cover 5 to be openable manually. In this state, the cover 5 can be manually turned upward, thereby causing the upper surface of the printer body 2 to reveal, as shown in FIG. 3. When the pushed state of the operation button 27*a* is released, the button 27*a* and the engaging element 26 are returned to their initial positions by the resiliency of the spring 29.

Then, an ink cartridge 85 is loaded into the cartridge receiving section 6 in the upper surface of the printer body 2 and then the cover 5 is again closed manually against the upper surface of the printer body 2. This causes the hook 24 of the cover 5 to enter the concavity 25, thereby engaging with the engaging element 26. This causes the cover 5 to engage with the printer body 2, thereby maintaining the printer body 2 closed appropriately, which is detected by the cover switch 33.

Then, as shown in FIGS. 1 and 2, an optical disk D is inserted upstanding into the printer body 2 from sideways with the label surface thereof facing this way on the printer 1. Then, the optical disk D is further moved along the conveyance path 15 into the cartridge receiving section 6. At this time, the optical disk D is guided with its lower portion received in the conveyance path 15 and with its upstanding substantially middle portion received in the inlet 21 in the cover 5. When the optical disk D is inserted into the inlet 21, the inlet cover 23*a* is pushed by the optical disk D, thereby turning upward so as to be upstanding.

When the optical disk D is inserted into the cartridge receiving section 6, the disk D comes into contact with the positioning stop 15*c* at a leading edge thereof in the conveyance path 15 and is set at a predetermined position where the disk D comes into contact with the guide surface 15*a* at the lower end thereof. Thus, the optical disk D is detected by the disk sensor 13. When the disk D is set at the predetermined set position within the cartridge receiving section 6, substantially the upper half of the disk D appears above the cover 5. Thus, the disk D is turned manually such that the direction of arrangement of characters preprinted on the label surface of the disk D is parallel to the longitudinal edge of the inlet cover 23*a*.

When the optical disk D is inserted into the inlet 21, thereby turning the inlet cover 23*a* upward, the lock member 31*a* protrudes from the relevant or right-hand side of the cover 5 outward into the hole 27*g* in the push button 27*a*, as shown in FIGS. 2 and 4. This makes it impossible to push the operation button 27*a* down or to release the engagement of the engaging element 26 with the hook 24 of the cover 5. Thus, the cover 5 is maintained engaged with the upper surface of the printer body 2. This prevents occurrence of a wrong operation such as inadvertently opening the cover 5 after the optical disk D is inserted into the cartridge receiving section 6.

Then, required character keys of the key-in unit 3 are pressed, thereby inputting print information, and then a start key is operated, thereby starting the printing. This causes the thermal head 8 to move toward the platen 7, and the optical disk D is then held and restrained between the thermal head 8 and the platen 7. Then, the platen 7 is rotated and the optical disk D is conveyed along the conveyance path 15 toward the discharge section 15*b*. During conveyance, desired information such as a title is printed by the thermal head 8 on the label surface of the disk D.

When the printing ends, the optical disk D is conveyed to the discharge section 15*b*, and the thermal head 8 is then separated from the platen 7, thereby releasing the optical disk D from the restriction between the thermal head 8 and the platen 7. When the optical disk D is in the discharge section 15*b*, the downstream side part of the disk D is inserted into the inlet 21 with the inlet cover 23*a* upstanding. Thus, engagement of the engaging element 26 with the hook 24 of the cover 5 is in an unreleasable state.

When the user takes out the optical disk D from the printer 1, the upstanding inlet cover 23*a* in contact with the label surface of the optical disk D is turned downward around the pair of axles 22 due to the weight thereof, which causes the inlet 21 to be covered by the inlet cover 23*a*. In conjunction with the downward turning of the inlet cover 23*a*, the lock member 31*a* is moved away from the hole 27*g* in the operation button 27*a* and then retracts into the relevant side of the cover 5, thereby allowing the operation button 27*a* to be pushed manually. Thereafter, when the ink cartridge 85 in the cartridge receiving section 6 need be exchanged with another or a tape cartridge 70, the operation button 27*a* is pushed, thereby releasing the engagement of the cover 5 with the engaging element 26. In this state, the cover 5 is turned manually upward to cause the opening 6*a* for the cartridge receiving section 6 to appear for exchanging purposes.

As described above, as long as the optical disk D is present in the conveyance path 15 from termination of the printing operation on the optical disk D to its discharge to the discharge section 15*b*, the pushing operation of the operation button 27*a* is prevented by the lock member 31*a* operating in conjunction with the operation of the inlet cover 23*a*. That is, the pushing operation of the operation button 27 cannot be performed until the optical disk D is moved away from the printer body 2 (or the conveyance path 15). This serves to prevent occurrence of troubles such as damaging the label surface of the optical disk D with the inner edge of the inlet 21 in the inlet cover due to inadvertent opening of the cover 5 and damaging the conveyability of the optical disk D due to inadvertently pushing the operation button 27*a*, thereby avoiding the incomplete closed state of the cover 5 and hence improper printing of the optical disk D.

Figure 20:
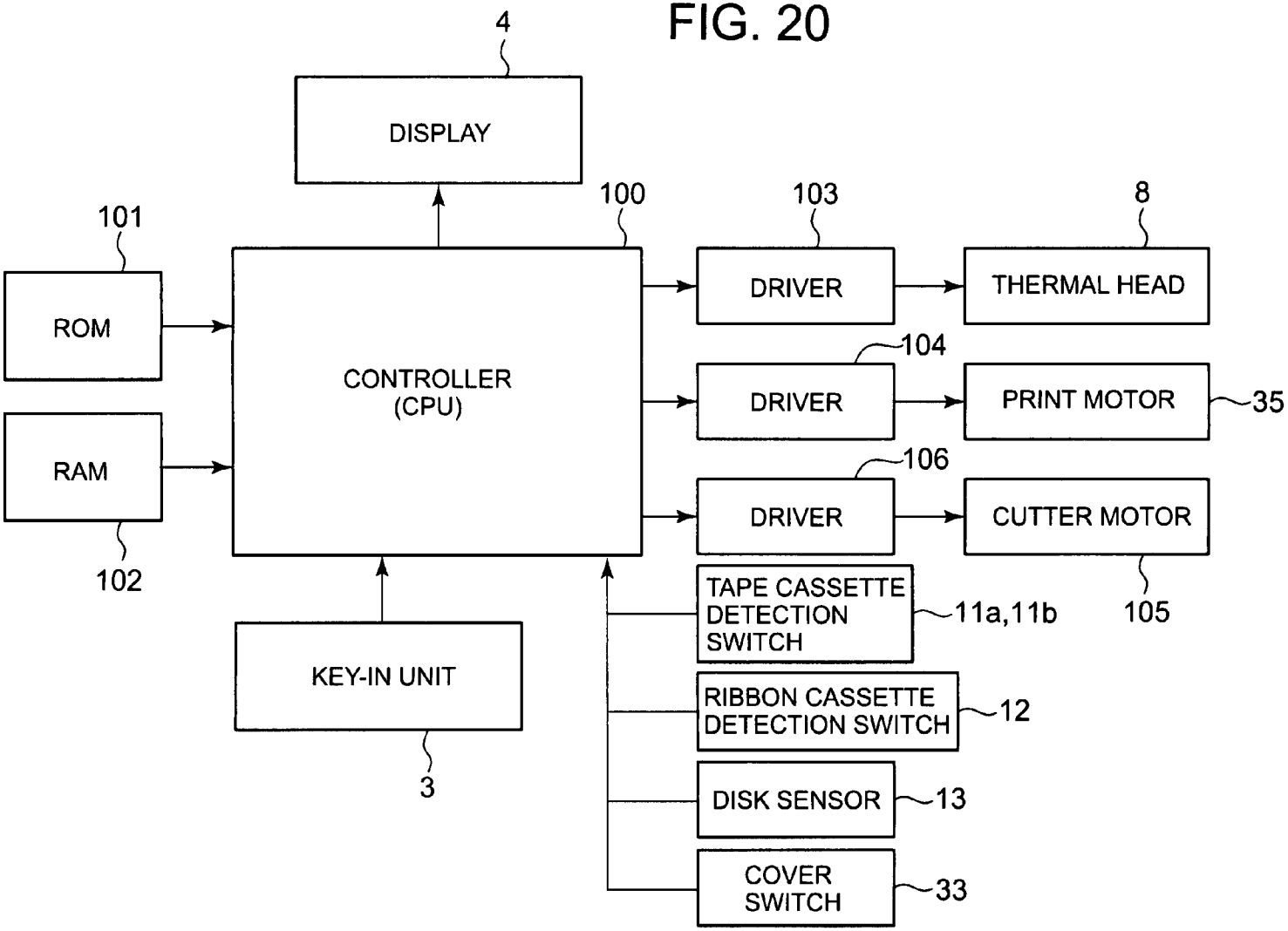
FIG. 20 is a block diagram of an electric circuit for the printer.

FIG. 20 is a block diagram of an electrical circuit for the printer 1 in this embodiment. The printer 1 comprises a controller (for example, including a CPU) 100 that controls the whole printer. The controller 100 is connected to a ROM 101 and a RAM 102. The ROM 101 has stored programs such as a system program to control the respective elements of the printer 1 and data on a table for setting current supply time durations for the heaters of the thermal head 8 depending on either a tape printing mode in which a tape is printed or a disk printing mode in which an optical disk D is printed. The RAM 102 comprises a memory for storing input data and a memory for storing a print pattern data. Furthermore, the RAM 102 temporarily stores data required for printing.

The controller 100 is also connected to the key-in unit 3, the display 4, a driver 103 for the thermal head 8, a driver 104 for the printing motor 35, and a driver 106 for the cutter motor 105. The controller 100 is furthermore connected to the tape cartridge sensors 11*a* and 11*b*, the ink cartridge sensing switch 12 and the disk sensor 13. Furthermore, the controller 100 is connected to a cover switch 33 that detects that the cover hook 24 is appropriately engaged with the engaging element 26 and thus the cover 5 is appropriately closed at a predetermined position against the upper surface of the printer body 2.

Figure 21:
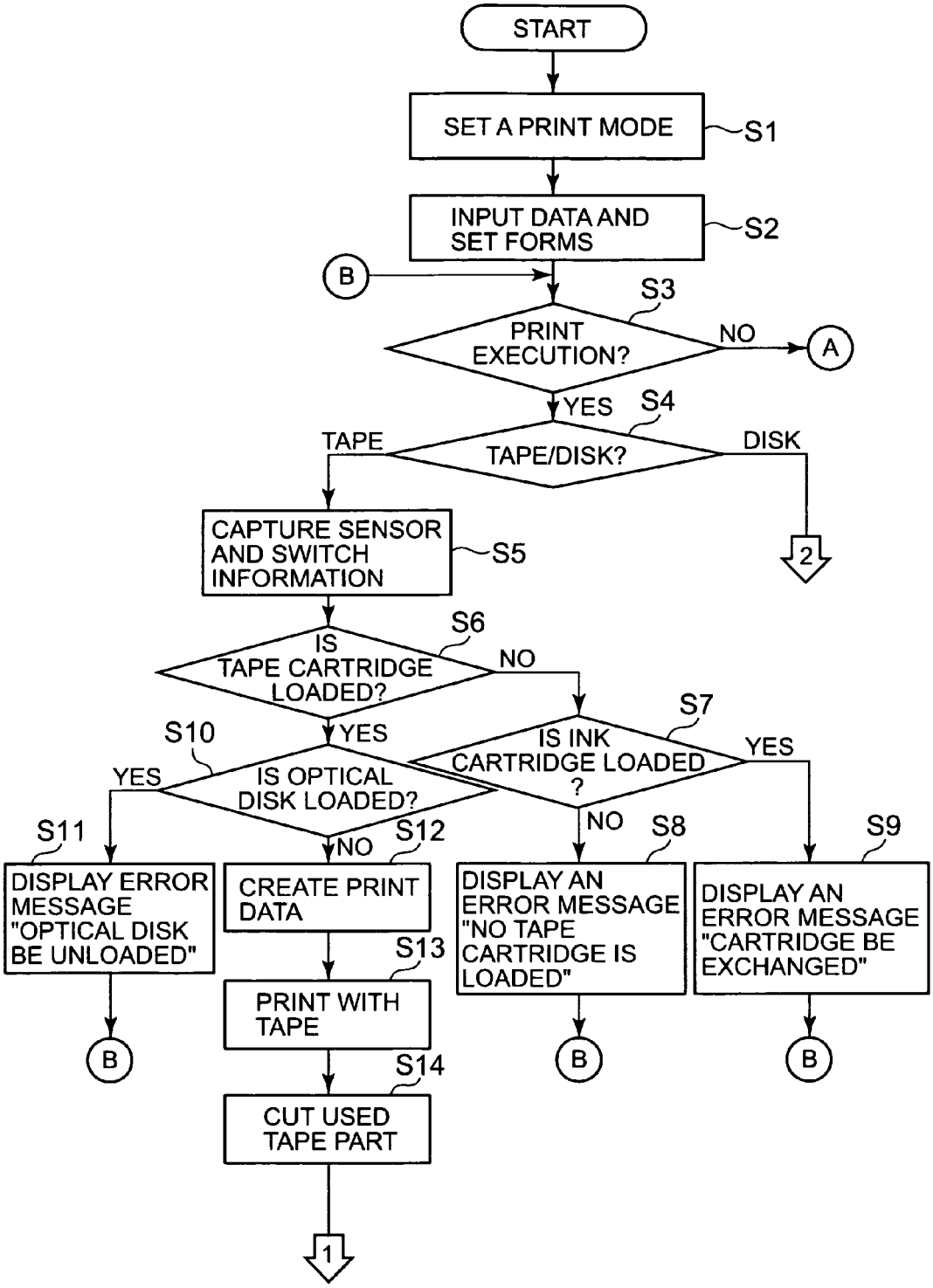
FIG. 21 is a flowchart indicative of a part of a flow of operation by the printer.
Figure 22:
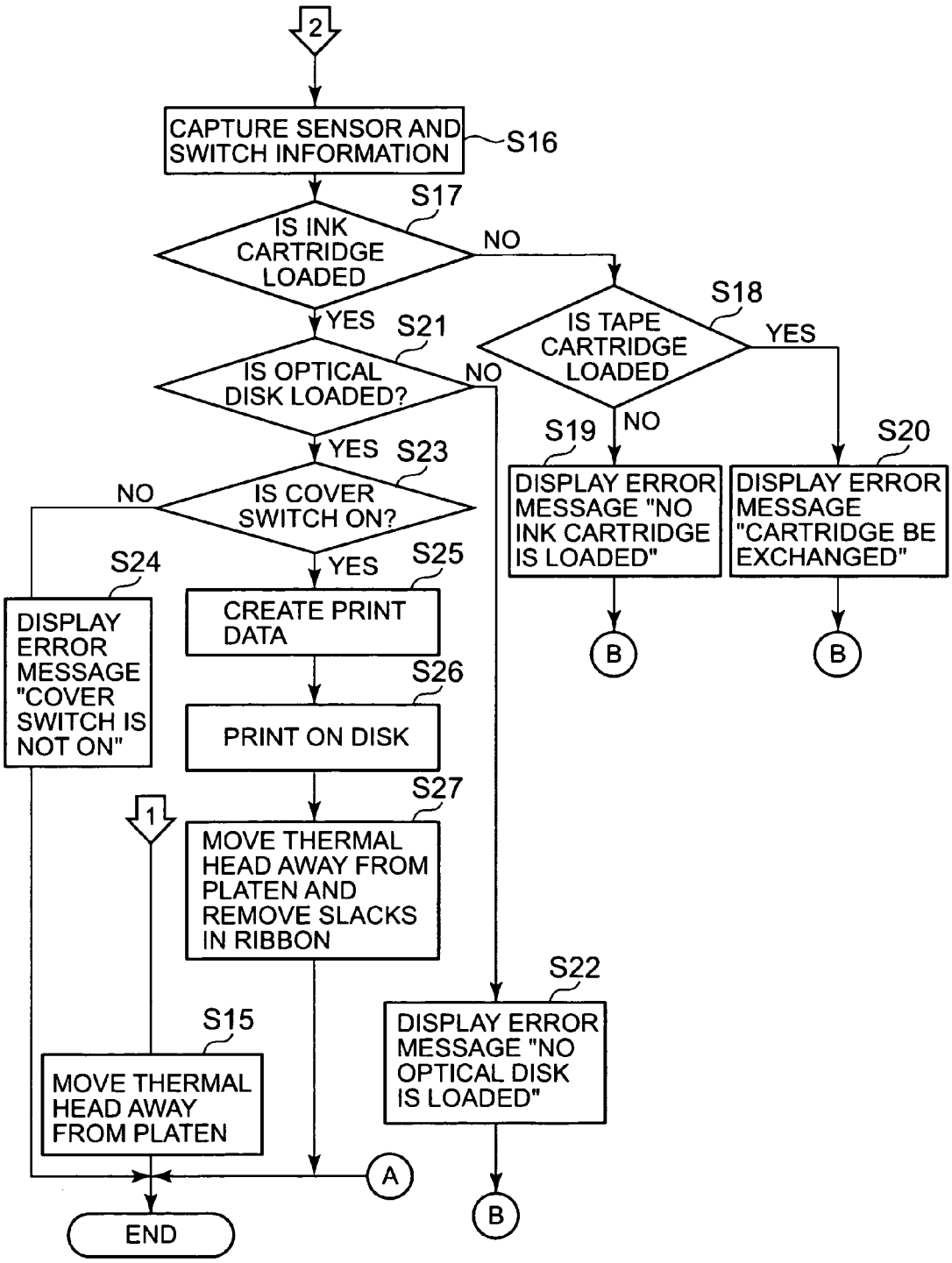
FIG. 22 is a flowchart indicative of the remainder of the flow of operation by the printer.

The printing operation to be performed by the printer 1 will be described with reference to the flowcharts of FIGS. 21 and 22. First, the display screen 4 is caused to display on a menu picture tape the printing mode in which a printing object is a tape and the disk printing mode in which the printing object is an optical disk D, thereby causing the operator to select one of the printing modes (step S1). Then the display screen 4 is caused to display an input edition picture and a form setting picture. The user then inputs character information to be printed at the key-in unit 3, or sets form information such as character sizes, the number of lines for printing and fonts to be used (step S2). It is then determined whether printing based on operation of the print key of the key-in unit 3 has been commanded (step S3). If so (YES in step S3), it is determined whether the set printing mode is for the printing tape or the optical disk D (step S4). If not (NO in step S3), the processing ends.

If the tape printing mode is set, information on the tape cartridge detection switches 11*a* and 11*b*, the ink cartridge detection switch 12 and the disk sensor 13 provided in the cartridge receiving section 6 is captured (step S5). Then, it is determined based on information from the tape cartridge detection switches 11*a* and 11*b* whether the tape cartridge 70 is loaded in the cartridge receiving section 6 (step S6).

If not (NO in step S6), it is determined whether an ink cartridge 85 is loaded in the cartridge receiving section 6 (step S7). If not (NO in step S7), an error message is displayed on the display 4, indicating that no tape cartridge 70 is loaded (step S8), and then control passes to step S3 where a print execution command is waited. Meanwhile, the user can load a tape cartridge 70 into the cartridge receiving section 6 and then give a print execution command again.

When it is determined that the ink cartridge 85 is loaded in the cartridge receiving section 6 (YES in step S7), an error message is displayed on the display 4, indicating that a tape cartridge 70 should be loaded instead of the ink cartridge 85 (step S9). Then control passes to step S3 in which the print execution command is waited. Thus, the user can exchange the ink cartridge 85 loaded in the cartridge receiving section 6 with the tape cartridge 70 and then give the print execution command again.

When it is determined that the tape cartridge 70 is loaded in the cartridge receiving section 6 (YES in step S6), then it is further determined whether an optical disk D is loaded in the cartridge receiving section 6 (step S10). If so (YES in step S10), an error message is displayed on the display 4, indicating that an optical disk D loaded should be removed (step S11). Then control passes to step S3 where the print execution command is waited. Thus, the user can remove the optical disk D loaded in the cartridge receiving section 6 and then give the print execution command again.

When it is determined that no optical disk D is loaded in the cartridge receiving section 6 (NO in step S10), print data including character information inputted based on the tape cartridge information including set forms and captured tape width information is created (step S12). Then, the printing motor 35 is driven to press the thermal head 8 against the platen 7 and rotate the platen 7 and the ribbon winding shaft 9. Then, the heaters of the thermal head 8 are heated based on the print data, thereby transferring an ink in the ink ribbon 7 thermally to the printing tape 71 for printing purposes (step S13).

When the printing has ended, the cutter motor 105 drives the cutter mechanism 17 in a state where the thermal head 8 is pressed against the platen 7, thereby cutting a used tape portion 71 (step S14). Then, the printing motor 35 is driven reversely to move the thermal head 8 away from the platen 7, thereby terminating the process (step S15).

When it is determined in step S4 that the set printing mode is the disk printing mode, information on the tape cartridge detection switches 11*a* and 11*b*, the ink cartridge detection switch 12 and the disk detection switch 13 provided in the cartridge receiving section 6 is captured (step S16). Then it is determined whether an ink cartridge 85 is loaded in the cartridge receiving section 6 based on the information on the ink cartridge detection switch 12 (step S17).

When it is determined that no ink cartridge 85 is loaded in the cartridge receiving section 6 (NO in step S17), it is then determined whether a tape cartridge 70 is also loaded in the cartridge receiving section 6 (step S18). If not (NO in step S18), an error message is displayed on the display 4, indicating that no ink cartridge 85 is loaded in the cartridge receiving section 6 (step S19). Then control passes to step S3 where the print execution command is waited. The user can load an ink cartridge 85 into the cartridge receiving section 6 and then give the print execution command again.

When it is determined that the tape cartridge 70 is loaded in the cartridge receiving section 6 (YES in step S18), an error message is displayed, indicating that the tape cartridge 70 loaded in the cartridge receiving section 6 should be exchanged with an ink cartridge 85 (step S20). Then control passes to step S3 where the print execution command is waited. Thus, the user can exchange the tape cartridge 70 loaded in the cartridge receiving section 6 with the ink cartridge 85 and then give the print execution command again.

When it is determined that the ink cartridge 85 is loaded in the cartridge receiving section 6 (YES in step S17), it is then determined whether the optical disk D is also loaded in the cartridge receiving section 6 (step S21). If not (NO in step S21), an error message is displayed, indicating that no optical disk D is loaded in the cartridge receiving section 6 (step S22), and then control passes to step S3 where the print execution command is waited. Thus, the user can load an optical disk D in the cartridge receiving section 6 and then give the print execution command again.

When it is determined that the optical disk D is loaded in the cartridge receiving section 6 (YES in step S21), it is then determined whether the cover switch 33 is on (step S23). If not or the cover is incompletely closed, there is a possibility that bad printing will occur. Thus, an error message indicating this point is displayed on the display 3 (step S24) because there is a possibility that bad printing will occur, thereby inhibiting execution of the printing process and then terminating the process. When the cover switch 33 is on (YES in step S23), print data on character information inputted based on the set forms is created (step S25). Then, as shown in FIGS. 14-16 the printing motor 35 is driven forwardly, thereby pressing the thermal head 8 against the platen 7 and rotating the platen 7 and the ribbon winding shaft 9. Then the heaters of the thermal head 8 are heated based on the print data to thermally transfer the ink in the ink ribbon 8 to the label surface of the optical disk D for printing purposes (step S26).

When this printing ends, the optical disk D is conveyed to the discharge section 15*b* at the downstream end of the conveyance path 15 and then stops there in a state in which the optical disk D is supported in the discharge section 15*b*. Subsequently, as described with reference to FIGS. 17 and 18 the printing motor 35 is driven in the reverse direction, thereby moving the thermal head 8 away from the platen 7, and then further driven in the same reverse direction for a predetermined time to remove slacks in the ink ribbon 8 and then this process ends (step S27).

As will be described in the printing process of FIGS. 21 and 22, when the cover 5 is inappropriate closed against the upper surface of the printer body 2, or deviates from the proper closed position thereof, and engagement of the hook 24 with the engaging member 26 or engagement of the cover 5 with the printer body 2 is inappropriate, this state is detected by the cover switch 33. When the optical disk D loaded into the printer body 2 in this state is detected by the disk sensor 13, the controller 100 gives a warning based on detection signals from the disk sensor 13 and the cover switch 33 that the cover 5 is closed incompletely and the content of the warning is indicated on the display 4 (step S24).

Thus, the user notices based on the warning that the cover 5 is inappropriately closed and then can reclose the cover 5 appropriately. If printing is performed with the cover closed inappropriately, there is a possibility that the optical disk to be conveyed will hit the inner edge of the inlet 21 in the cover 5, thereby performing inappropriate printing. However, since in this embodiment the warning is given beforehand and the user can re-close the cover 5 correctly, no inappropriate printing is prevented.

When the cover switch 33 detects that the engagement of the cover 5 with the printer body 2 is incomplete and the disk sensor 13 detects that the optical disk D is loaded in the printer body 2, the controller 100 inhibits driving the platen 7 and the thermal head 8. Thus, even if the print start key is operated wrongly with the cover 5 closed inappropriately, no printing is performed and troubles such as inappropriate printing are avoided.

Figure 23:
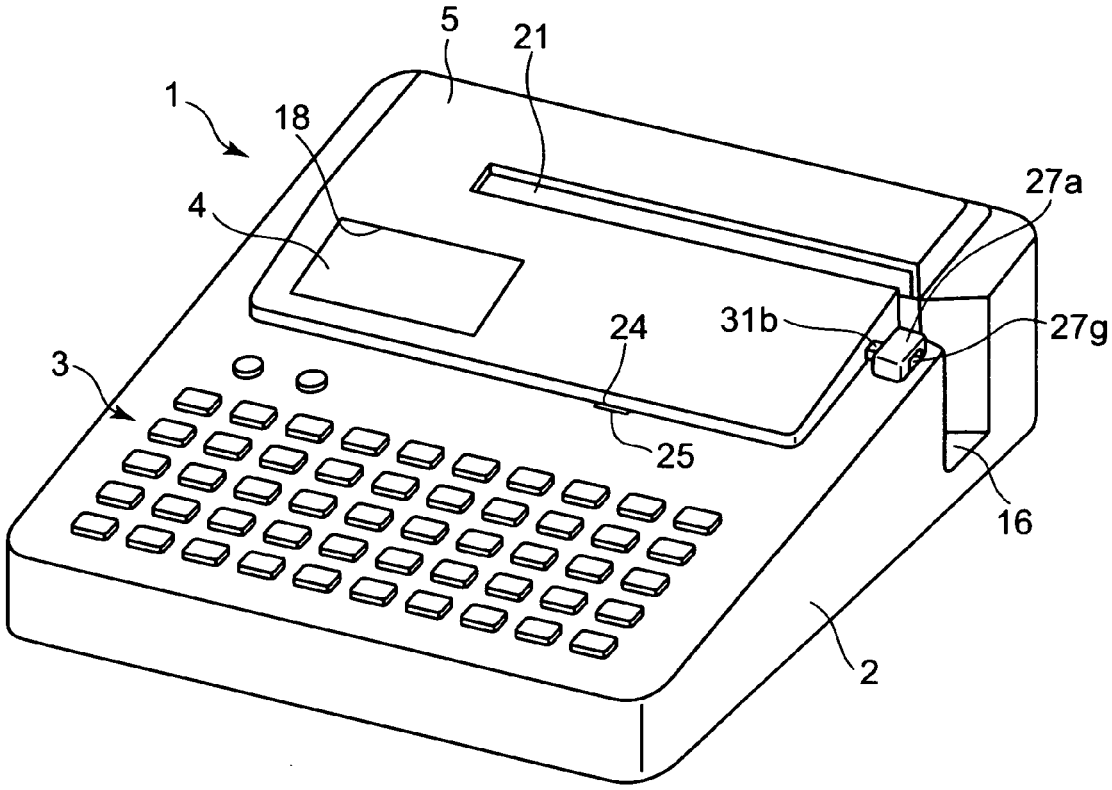
FIG. 23 is a perspective view of a second embodiment of the printer according to the present invention.
Figure 24:
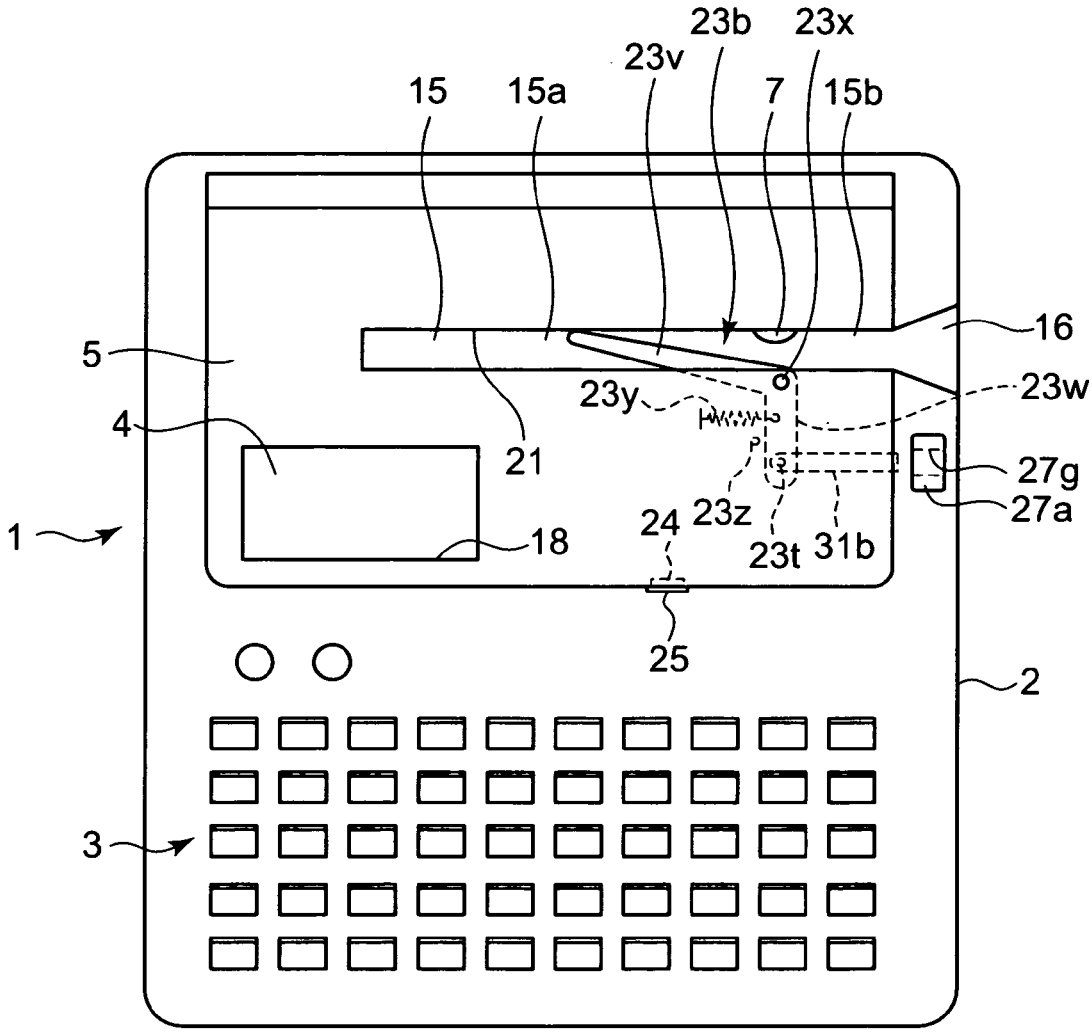
FIG. 24 is a plan view of this printer.

FIGS. 23 and 24 show a second embodiment in which no inlet cover for the inlet 21 is provided, and an L-shaped lever 23*b* is provided below the cover 5. The lever 23*b* has a sliding piece 23*v* and an interlock piece 23*w* and is supported at a pivot 23*x* in the vicinity of the corner of the L thereof by a lower surface of the cover 5. The lever 23*b* is resiliently biased clockwise through a spring 23*y* in FIG. 24 and normally abuts on a stop 23*z* which restricts further clockwise rotation of the lever. Thus, the lever 23*b* is held at its initial position.

When the lever 23*b* is at its initial position, the sliding piece 23*v* is disposed so as to extend upstream of the conveyance path 15 from the pivot 23*x* diagonally across the slit-like inlet 21 in the cover 5 below the inlet 21. A lock member 31*b* is connected at a pivot 23*t* to the interlock piece 23*w* of the lever 23*b* such that the lock member 31*b* moves in the width direction of the cover 5 in accordance with turning of the lever 23 so as to protrude/sink outward/inward from the right side of the cover 5 in FIG. 24.

As in the first embodiment, the operation button 27*a* provided on the upper surface of printer body 2 has a through hole 27*g* into which the lock member 31*b* protrudes from the right side of the cover 5 in accordance with the turning of the lever 23*b*.

When, for example, a predetermined character string is printed on the label surface of the optical disk D, the operation button 27*a* will be pushed in a state in which the cover 5 is closed against the upper surface of the printer body 2, thereby causing the cover 5 to be disengaged from the printer body 2. Then, the cover 5 is manually turned upward, thereby causing the printer body 2 to appear. Then, an ink cartridge is loaded into the cartridge receiving section in the printer body 2 and then the cover 5 is again closed against and engaged with the upper surface of the printer body 2.

Then, the optical disk D is inserted upstanding sideways from the opening 16 into the printer body 2 with the label surface thereof facing this way, moved along the conveyance path 15 and the inlet 21, and then loaded into the cartridge receiving section. At this time, the sliding piece 23*v* of the lever 23*b* extends obliquely across the inlet 21 in the cover 5 below the inlet 21. Thus, when the optical disk D is inserted into the inlet 21 and then moved along the inlet 21, the optical disk D hits the lever sliding piece 23*v*, thereby turning the lever 23*b* counterclockwise in FIG. 24 around the pivot 23*x* against the resiliency of the spring 23*y*. This causes the lock member 31*b* to protrude from the right side of the cover 5 into the through hole 27*g* in the operation button 27*a*.

Wrong vertical insertion of the optical disk D from above the cover 5 through the inlet 21 into the printer body 2 is stopped by the sliding piece 23*v* of the lever 23*b* disposed so as to extend obliquely across the inlet 21 below this inlet. Thus, the user notices that the direction of this insertion is wrong and reinserts the disk normally from sideways. At this time, the lock member 31*b* protrudes from the right side of the cover 5 into the through hole 27*g* in the operation button 27*a*, thereby making it impossible to operate the operation button 27*a*, or to release the engagement of the cover 5 with the printer body 2. Thus, this prevents occurrence of a wrong operation such as opening the cover 5 inadvertently after the optical disk D is inserted into the printer body 2.

In this second embodiment, the lever 23*b* is disposed so as to involve the conveyance path 15 for the optical disk D. The lever sliding piece 23*v* is pushed by the optical disk D loaded to its set position, thereby turning from the initial position thereof to the predetermined position thereof. When the lever sliding piece 23*v* is in sliding contact with the label surface of the optical disk D moving along the conveyance path 15 from the set position of the optical disk D to its discharge position 15*b*, the lever sliding piece 23*v* is held at the predetermined position. The lock member 31*b* is shifted from its non-lock position to its lock position by the turning of the lever member 23*b* from its initial position to its predetermined position, thereby locking the operation button 27*a*.

When, after printing, the optical disk D present on the discharge section 15*b* is taken out, the lever 23*b* is released from a state in which the lever 23*b* is pressed by the optical disk D, thereby turning the lever 23*b* by the resiliency of the spring 23*y* around the pivot 23*x* clockwise in FIG. 24, abuts on the stop 23*z* and then returns to its initial position. In conjunction with the returning operation of the lever member 23*b*, the lock member 31*b* retracts into the cover 5, thereby moving away from the hole 27*g* in the operation button 27*a*. This renders the operation button 27*a* operable manually. When the ink cartridge within the printer body 2 is replaced with another or a tape cartridge, the operation button 27*a* is required to be pushed down, thereby releasing the cover 5 from the printer body 2. In this state, the cover 5 is required to be manually turned upward, thereby causing the opening for the cartridge receiving section to appear.

As described above, in the embodiment 2 the pushing operation of the operation button 27*a* is prevented by the lock member 31*b* as long as the optical disk D is loaded into the printer body 2. Thus, troubles are avoided that include opening the cover 5 inadvertently, thereby damaging the label surface of the optical disk D with the inner edge of the inlet 21 in the cover 5, and pushing the operation button 27*a* inadvertently, thereby making the closed state of the cover 5 unsteady, hence damaging the conveyability of the optical disk D and then printing on the optical disk D in inappropriate manner.

Figure 25:
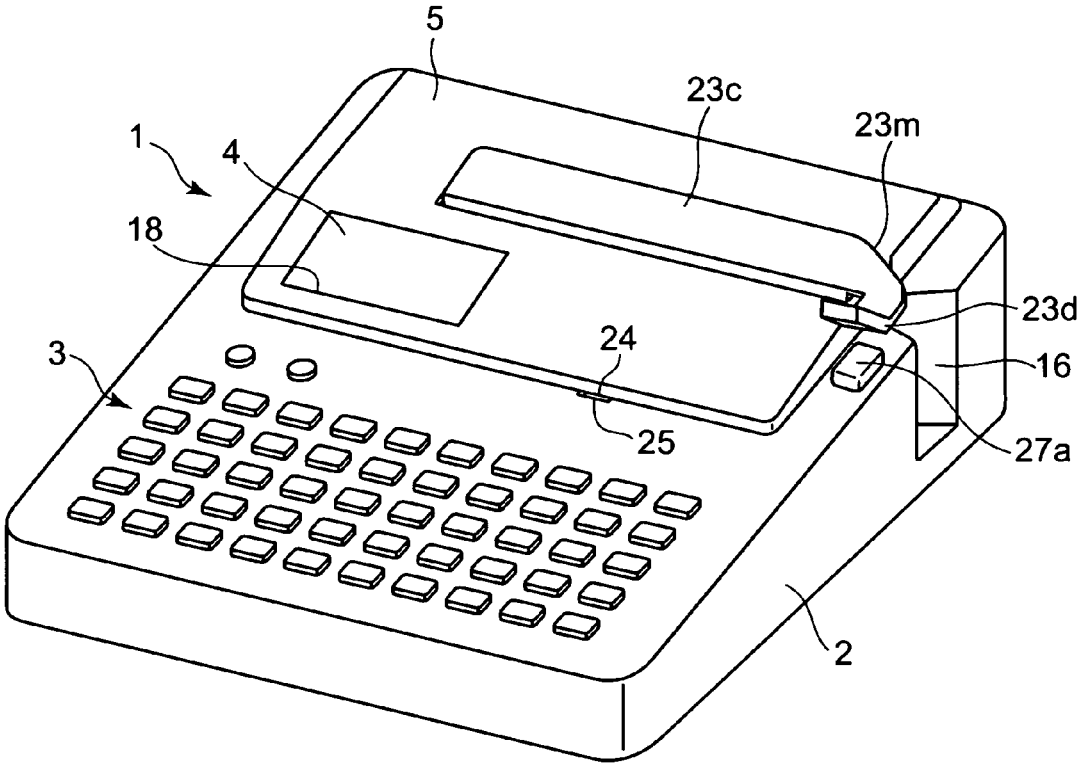
FIG. 25 is a perspective view of a third embodiment of the printer according to the present invention.
Figure 26:
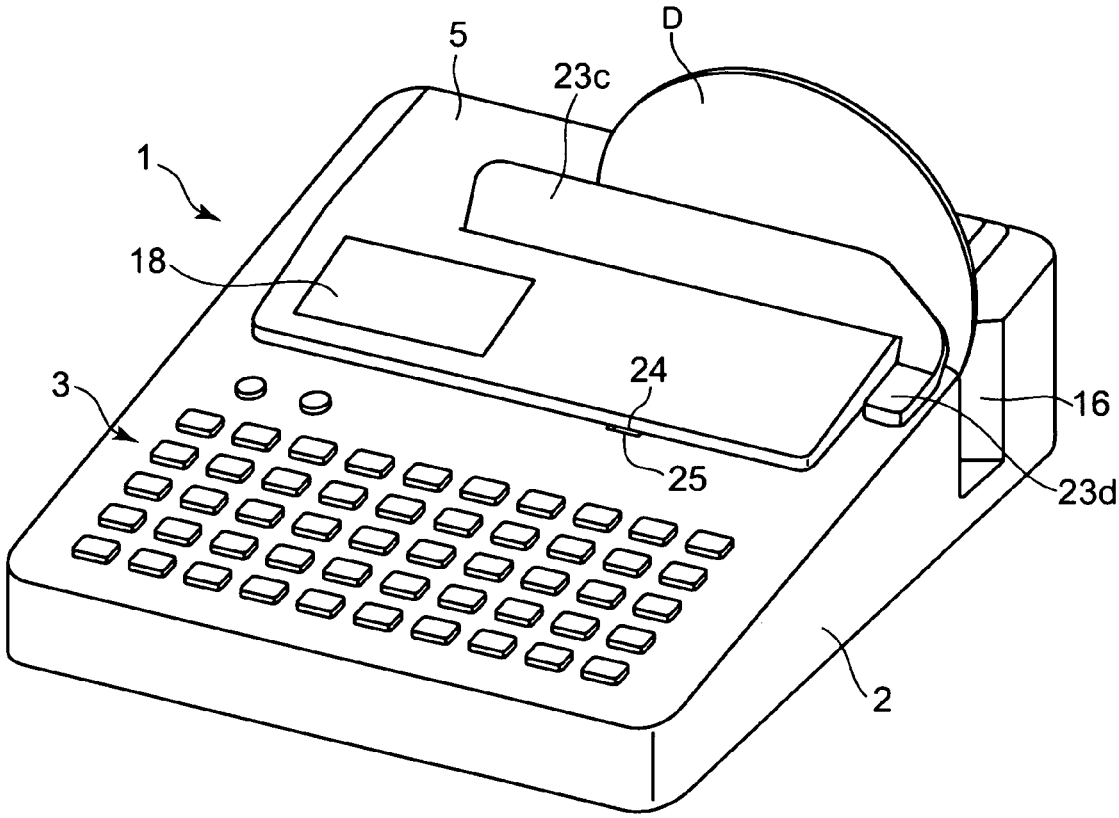
FIG. 26 is a perspective view of the printer into which an optical disk is loaded.

FIGS. 25 and 26 show a third embodiment in which the inlet cover 23*c* has a shield 23*d* for the operation button 27*a* extending this way perpendicular to the plane of the inlet cover 23*c* at its right end. The shield 23*d* takes the form of a flat box open at its lower end. As shown in FIG. 25, when the inlet cover 23*c* is lying flat onto the cover 5, thereby covering the inlet 21 in the inlet cover 23*c*, the operation button 27*a* is revealed such that the operation button 27*a* is manually operable. When, as shown in FIG. 26, the inlet cover 23*c* is turned upward so as to be upstanding, the shield 23*d* is turned so as to cover the whole operation button 27*a*, thereby making it impossible to operate the operation button 27*a* manually.

A printing method to be performed in this embodiment will be described next. First, when the cover 5 is closed against the upper surface of the printer body 2 and the inlet 21 in the cover 5 is covered with the inlet cover 23*c*, the operation button 27*a* is pushed to release the engagement of the cover 5 with the printer body, thereby opening the cover 5. Then, an ink cartridge 85 is loaded into the cartridge receiving section 6. At this time, the shield 23*d* of the inlet cover 23*c* is upstanding so as to reveal the operation button 27*a*. Thus, the operation button 27*a* is operable manually without any trouble.

Then, the cover 5 is closed against, and engaged with, the printer body 2. As shown in FIG. 26, in this state the optical disk D is inserted upstanding from sideways at the opening 16 into the printer body 2 and hence the cartridge receiving section 6 with the label surface facing this way. At this time, the inlet cover 23*c* is pushed by the optical disk D, thereby turning upward so as to be upstanding. This causes the shield 23*d* of the inlet cover 23*c* to cover the whole operation button 27*a*. This makes it impossible to push the operation button 27*a*. Thus, the engagement of the cover 5 with the upper surface of the printer body 2 is maintained. This prevents occurrence of a wrong operation such as opening the cover 5 inadvertently after the optical disk D is inserted into the cartridge receiving section 6.

Then, required character keys of the key-in unit 3 are operated to input corresponding print information and then the print start key is operated to give a command to start printing. Subsequent operations are similar to the other operations performed in the first embodiment. Thus, information such as a title is printed by the thermal head on the label surface of the disk D. When the printing ends, the optical disk D is conveyed to the discharge section 15*b*.

When the user takes out the optical disk D out of the printer in the discharge section 15*b*, the inlet cover 22*c* upstanding in contact with the label surface of the optical disk D is turned downward around the pair of axles 22 due to the weight thereof. This causes the inlet 21 to be covered with the inlet cover 23*c* and also causes the shield 23*d* to turn upward, thereby moving away from the operation button 27*a*. This renders the operation button 27*a* operable manually.

Then, when the ink cartridge in the printer body 2 should be replaced with another or a tape cartridge, the operation button 27*a* is pushed down to release the engagement of the cover 5 with the printer body 2. In this state, the cover 5 is turned manually upward, thereby revealing the opening 6*a* for the cartridge receiving section 6 for exchanging purposes.

As described above, in the third embodiment when the optical disk D is in the printer body 2 (or the conveyance path 15) from insertion thereof into the printer body 2 to the conveyance thereof to the discharge section 15*b*, pushing the operation button 27*a* is prevented by the shield 23*d* for the inlet cover 23*c*. Thus, this serves to prevents occurrence of troubles such as (1) opening the cover 5 inadvertently, thereby damaging the label surface of the optical disk D with the inner edge of the inlet 21 in the cover 5; and (2) pushing the operation button 27*a* inadvertently, thereby making a closed state of the cover 5 unsteady, damaging the conveyability of the optical disk D and as a result, printing the optical disk D in an inappropriate manner.

FIG. 27-30 show a fourth embodiment of the printer in which the cover 5 has on its back an L-shaped inlet cover 23*e* slidable in a predetermined range in a direction perpendicular to the extending direction of the inlet 21 provided in the cover 5. The inlet cover 23*e* comprises a strip-like cover piece 23*p* disposed at a position where the cover piece 23*p* closes the inlet 21, and an arm piece 23*q* extending toward the front of the printer body 2 from the right end of the inlet cover piece 23*p* when no optical disk D is loaded in the printer body 2. The inlet cover 23*e* has an inclined outer corner edge 23*m* in the vicinity of the opening 16 in the printer body 2 as in the inlet cover 23*a* of the first embodiment. The arm piece 23*q* has an end 23*r* inclined at 45 degrees to the extending direction thereof and abuts on an adjacent end of an L-shaped separable connection lever 28 provided in the vicinity of the right side edge of the printer body 2.

Figure 27:
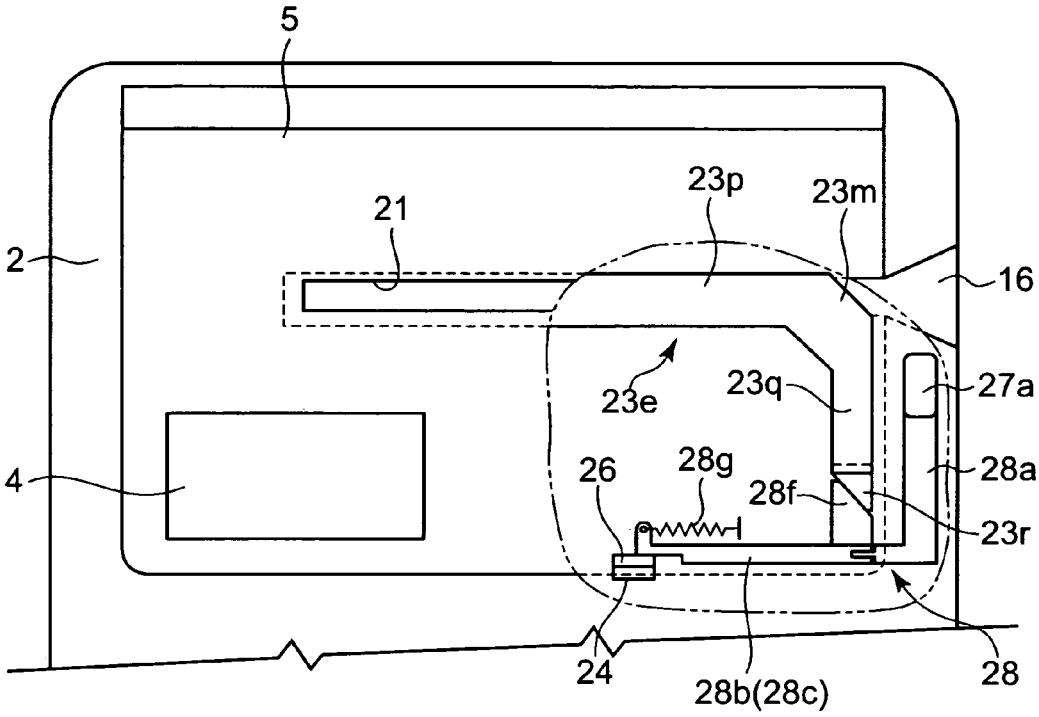
FIG. 27 is a plan view of a printer of a fourth embodiment of the present invention.
Figure 28:
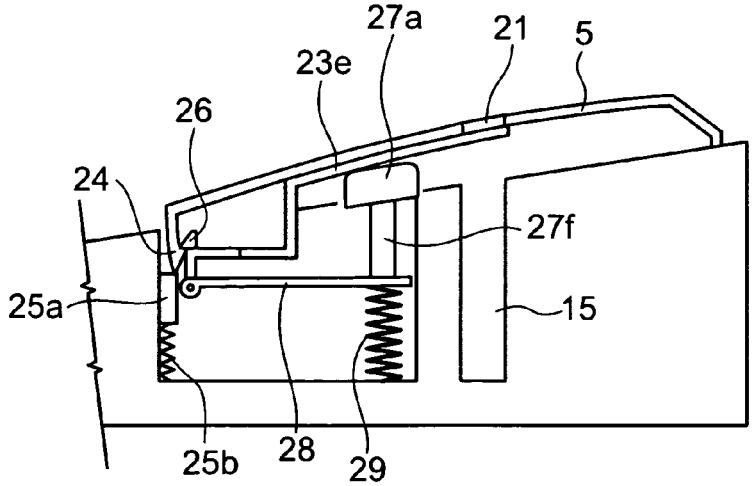
FIG. 28 illustrates the internal structure of a part of this printer.
Figure 29:
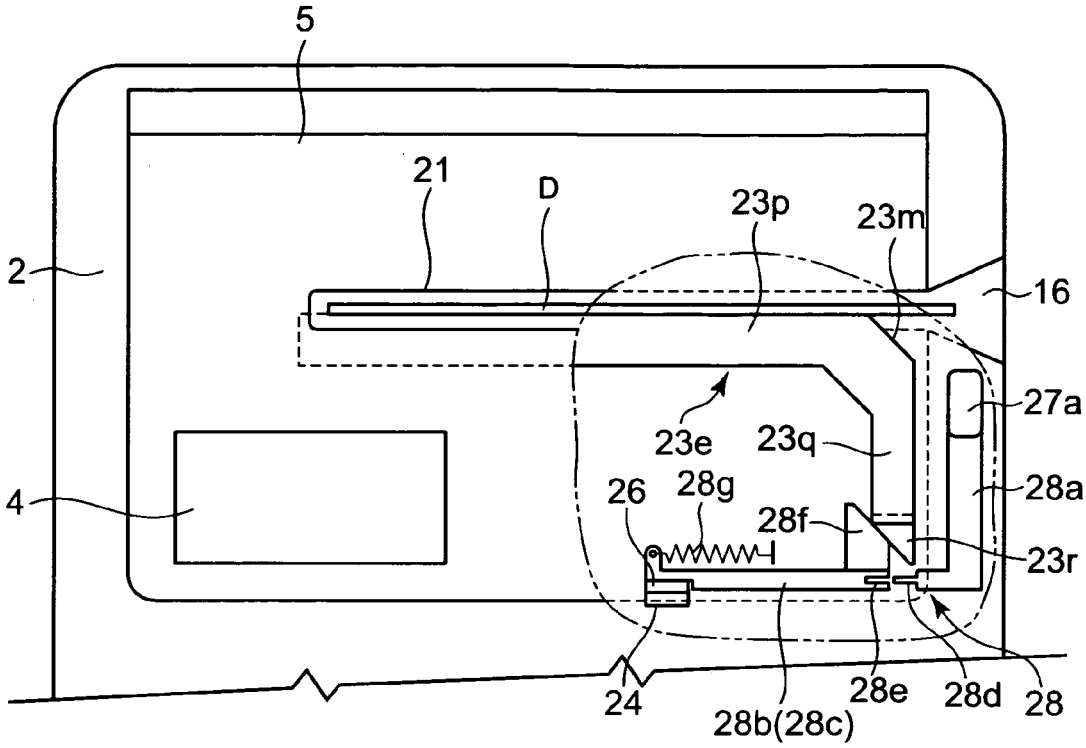
FIG. 29 is a plan view of this printer on which the optical disk is loaded.

As shown in FIGS. 27 and 29, in this embodiment the separable connection lever 28 releases the engagement of the hook 24 of the cover 5 with the engaging element 26 of the printer body 2 in accordance with operation of the operation button 27*a*. The connection lever 28 is separable in the vicinity of the corner of the L into two pieces 28*a* and 28*b*. The two lever pieces 28*a* and 28*b* are connected to the operation button 27*a* and the engaging element 26, respectively, at the distal ends thereof and have a convexity 28*d* and a concavity 28*e*, respectively, removably mated with each other at their adjacent ends thereof. One lever piece 28*b* has a protrusion 28*f* extending from the inner edge thereof in the vicinity of the concavity 28*e* thereof to the inlet cover 23*e*. The protrusion 28*f* has a 45°-inclined end sliddable on an inclined end 23*r* formed on the arm piece 23*q* of the inlet cover 23*e*. The connection lever 28 is biased by a spring 28*g* connected to the left end of the one lever piece 28*b* toward the other lever piece 28*a*.

Figure 30:
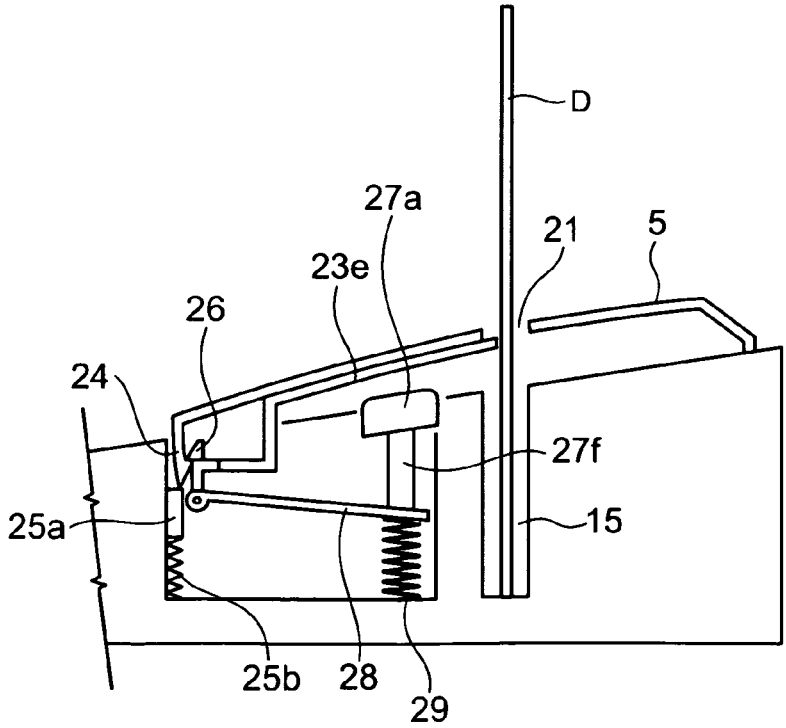
FIG. 30 illustrates the internal structure of a part of this printer into which the optical disk is loaded.

When in the printer an optical disk D is loaded into the printer body 2 through the inlet 21, the optical disk D hits the inclined corner edge 23*m* of the inlet cover 23*e* at a leading end thereof. This causes the optical disk D to push the inlet cover 23*e* toward the front side of the printer body 2 to a position where the inlet 21 is revealed (FIGS. 29 and 30).

At this time, the inclined edge 28*f* of the one lever piece 28*b* is in sliding relationship to the inclined end 23*r* of the arm piece 23*q* of the inlet cover 23*e*. Thus, the one lever piece 28*b* moves away and separates from the other lever piece 28*a* (FIGS. 29 and 30). Thus, when the optical disk D is loaded in the printer body 2, the user can push the operation button 27*a*, but its pushing force is not transmitted to the engaging element 26 and the user's pushing operation of the operation button 27*a* is invalidated.

When printing on the optical disk D ends and then the optical disk D is removed from the printer body 2, the one lever piece 28*b* returns to its initial position by the resiliency of the spring 28*g* and is then combined with the other lever piece 28*a*. This causes the one lever piece 28*b* to push and return the inlet cover 23*e* to its initial position.

As described above, in the fourth embodiment when the optical disk D is in the printer body 2 from the insertion thereof into the printer body 2 to the conveyance of the disk D to the discharge section 15*b*, pushing the operation button 27*a* is invalidated and the engagement of the cover 5 with the printer body 2 is not released in the closed state of the cover 5. This serves to prevent occurrence of troubles such as (1) opening the cover 5 inadvertently, thereby damaging the label surface of the optical disk D with the inner edge of the inlet 21 in the cover 5, and (2) pushing the operation button 27*a* inadvertently, thereby making the closed state of the cover 5 unsteady, damaging the conveyability of the optical disk D, and printing the optical disk D in an inappropriate manner.

Figure 31:
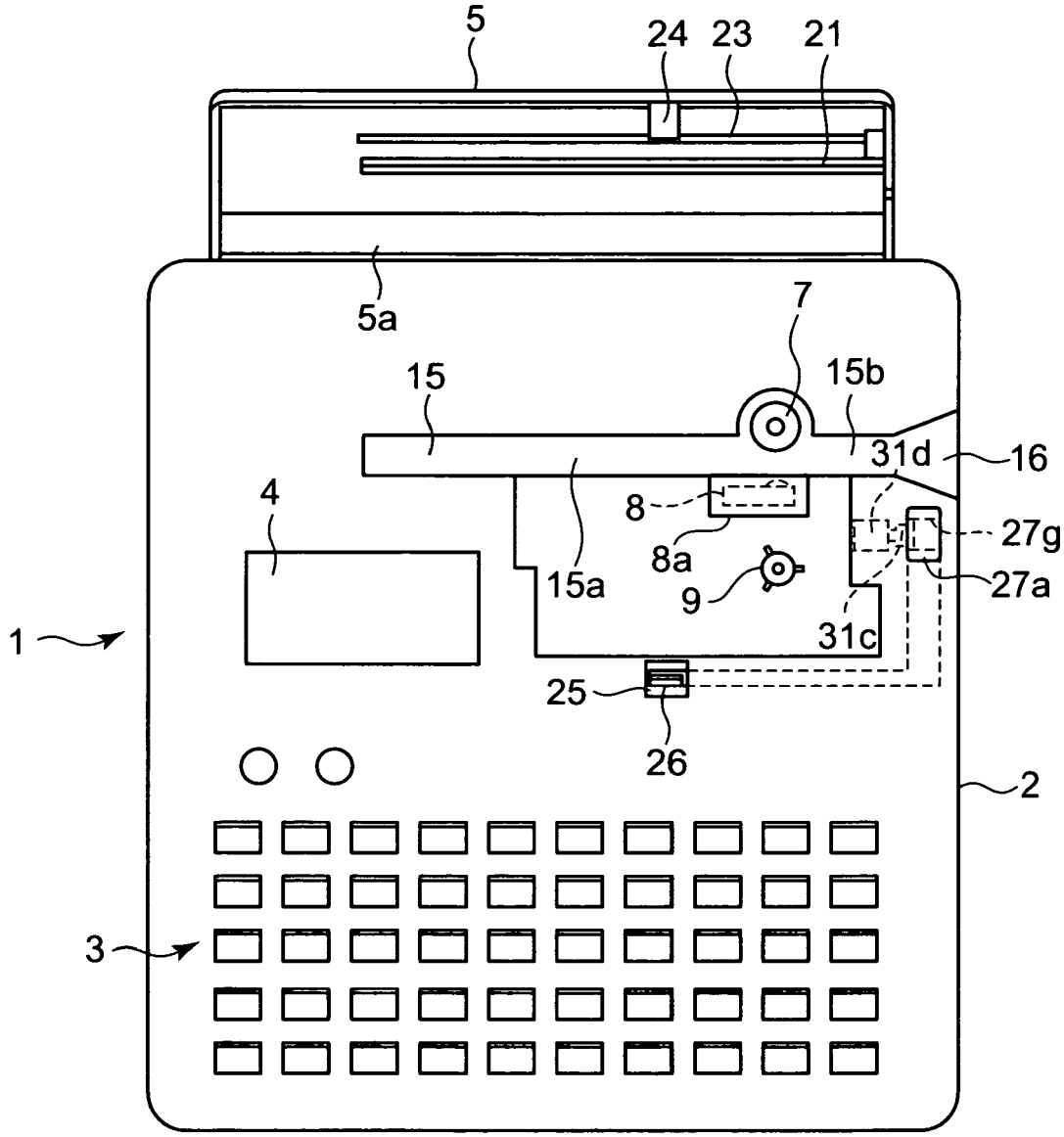
FIG. 31 is a plan view of a fifth embodiment of the printer according to the present invention.

FIG. 31 shows a fifth embodiment in which a lock member 31*c* engageable with the operation button 27*a* and a solenoid 31*d* as a drive source that drives the lock member 31*c* are provided within the printer body 2.

Figure 32:
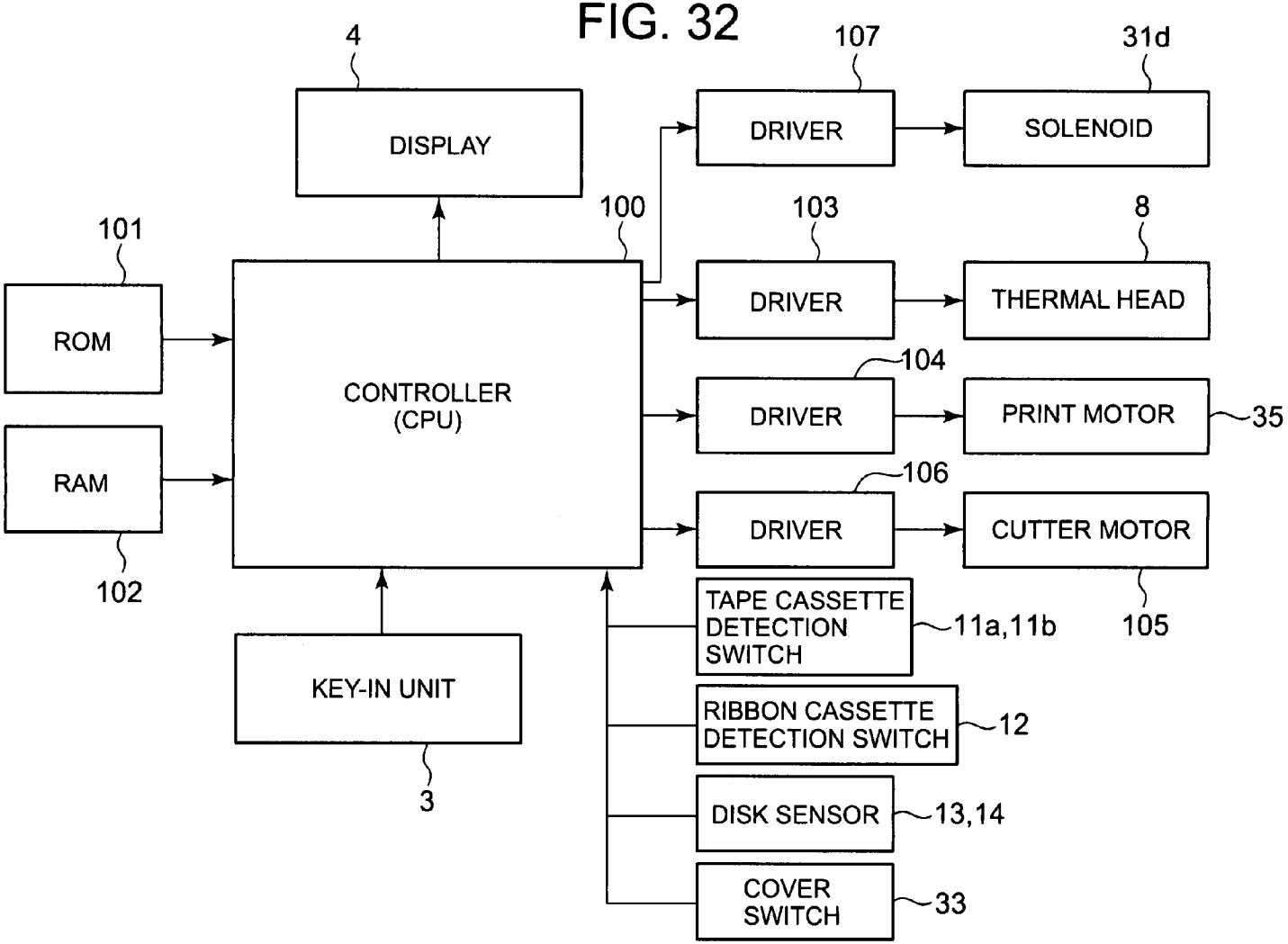
FIG. 32 is a block diagram of an electric circuit for this printer.

FIG. 32 is a block diagram of a control system for the printer of the fifth embodiment. The control system of the fifth embodiment is substantially the same as that of the first embodiment except that the drive force is used for inhibiting a release of the engagement of the cover 5 with the printer body 2. As shown in FIG. 32, a controller 100 is connected through a driver circuit 107 to the solenoid 31*d*. In the printer of the fifth embodiment, the controller 100 always monitors based on information from the disk sensor 19 whether or not an optical disk D is present in the conveyance path 15 in the printer body 2. As described above, the disk sensor 19 is provided at a position where it can sense the optical disk D that moves in the conveyance path 15 from an upstream set position where the printing starts to a downstream discharge position 15*b* where the printing ends. If the single disk sensor 14 cannot detect the optical disk D completely, a plurality of such disk sensors may be provided.

More particularly, the solenoid 31*d* is normally off and at this time the lock member 31*c* is at a disengaged position where the lock member 31*c* is disengaged from the operation button 27*a*. Thus, the operation button 27*a* is operable manually. When the optical disk D is inserted into the printer body 2 and detected by the disk sensor 14 provided within the cartridge receiving section 6, the controller 100 drives the solenoid 31*d* in accordance with the detection signal from the disk sensor 14, which causes the lock member 31*c* to protrude to a lock position where the lock member 31*c* engages with the operation button 27*a*, thereby locking and maintaining the operation button 27*a* inoperable.

When the label surface of the optical disk D is printed by the printer 1, the operation button 27 is pushed, the cover 5 is manually turned upward, thereby revealing the cartridge receiving section 6 and then an ink cartridge is loaded into the cartridge receiving section 6. Then, the cover 5 is closed against the upper surface of the printer body 2 in an engaged manner. In this state, the optical disk D is inserted upstanding into the cartridge receiving section 6 within the printer body 2 from the opening 16 with the label surface of the disk D facing this way and set at a predetermined position in the printer body 2.

When the optical disk D is set at the predetermined position within the cartridge receiving section 6, the optical disk D is detected by the disk sensor 14, and a corresponding detection signal is sent to the controller 100, which drives the solenoid 31*d* based on the detection signal. Then, the solenoid 31*d* causes the lock member 31*c* to protrude rightward, thereby engaging with the operation button 27*a* and hence rendering the same in an inoperable state. Thus, a wrong operation such as opening the cover 5 inadvertently is prevented after the optical disk D is inserted into the cartridge receiving section 6.

Then, character keys of the key-in unit 3 are operated to input print information and then the print start key is operated to give a command to start printing. Subsequent operations are similar to corresponding ones of the first embodiment and the printing process is performed in the same manner as is shown in FIGS. 21 and 22. Thus, desired information such as a title is printed on the label surface of the optical disk D with the thermal head. After printing, the optical disk D is conveyed to the discharge section 15*b*.

When the printed optical disk D is then taken out from the printer at the discharge section 15*b*, the disk sensor 14 detects that no optical disk D is present any longer in the printer body 2 and a corresponding signal is sent to the controller 100, which stops energizing the solenoid 31*d*. This causes the lock member 31*c* to move away, or be unlocked, from the operation button 27, thereby rendering the operation button 27*a* manually operable.

Figure 33:
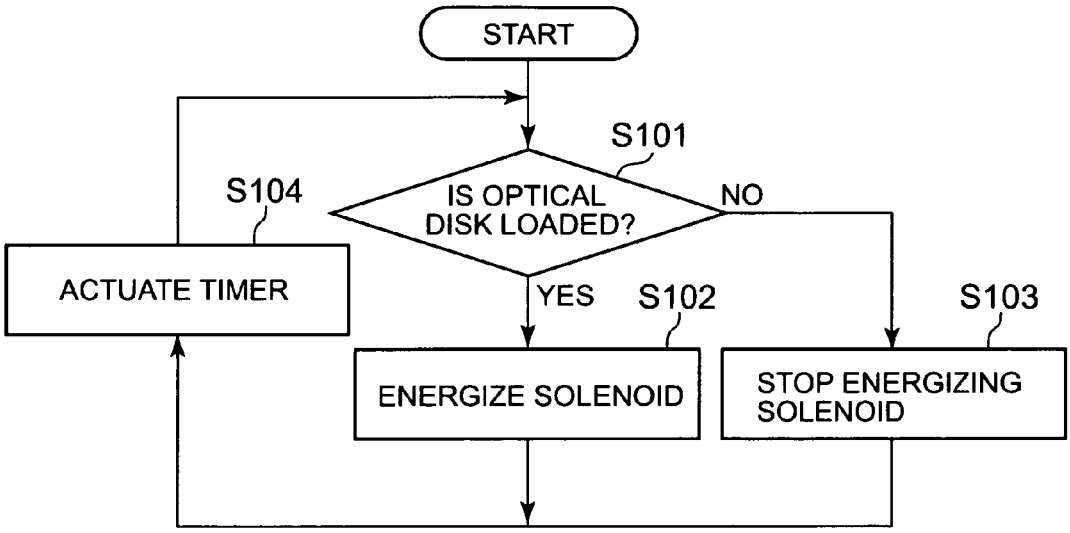
FIG. 33 is a flowchart indicative of a process for inhibiting a release of an engaged cover.

FIG. 33 is a flowchart of a process for inhibiting disengagement of the cover 5 by the controller 100, using the solenoid 31*d*. When a power source switch (not shown) of the printer 1 is turned on, the controller 100 monitors the state of the disk sensor 14 at all times. If the disk sensor 14 senses an optical disk D in the conveyance path 15 (YES in step 101), the controller energizes the solenoid 31*d*, thereby inhibiting disengagement of the cover 5 (S102). If the disk sensor 14 senses no optical disk D in the conveyance path 15 (NO in step 101), the controller then de-enegizes the solenoid 31*d*, thereby disengaging the cover 5 (S103). Then, a timer (not shown) is driven (S104), thereby iterating the steps S101-S103 at predetermined intervals of time.

As described above, in the printer 1 the pushing operation of operation button 27*a* is prevented by the lock member 31*c* as long as the optical disk D is loaded in the printer body 2. Thus, the fifth embodiment also serves to prevent occurrence of troubles such as (1) opening the cover 5 inadvertently, thereby damaging the label surface of the optical disk D with the inner edge of the inlet 21, and (2) pushing the operation button 27*a* inadvertently, thereby rendering the closed state of the cover 5 unsteady, damaging the conveyability of the optical disk D, and hence printing the optical disk D in an inappropriate manner.

Figure 34:
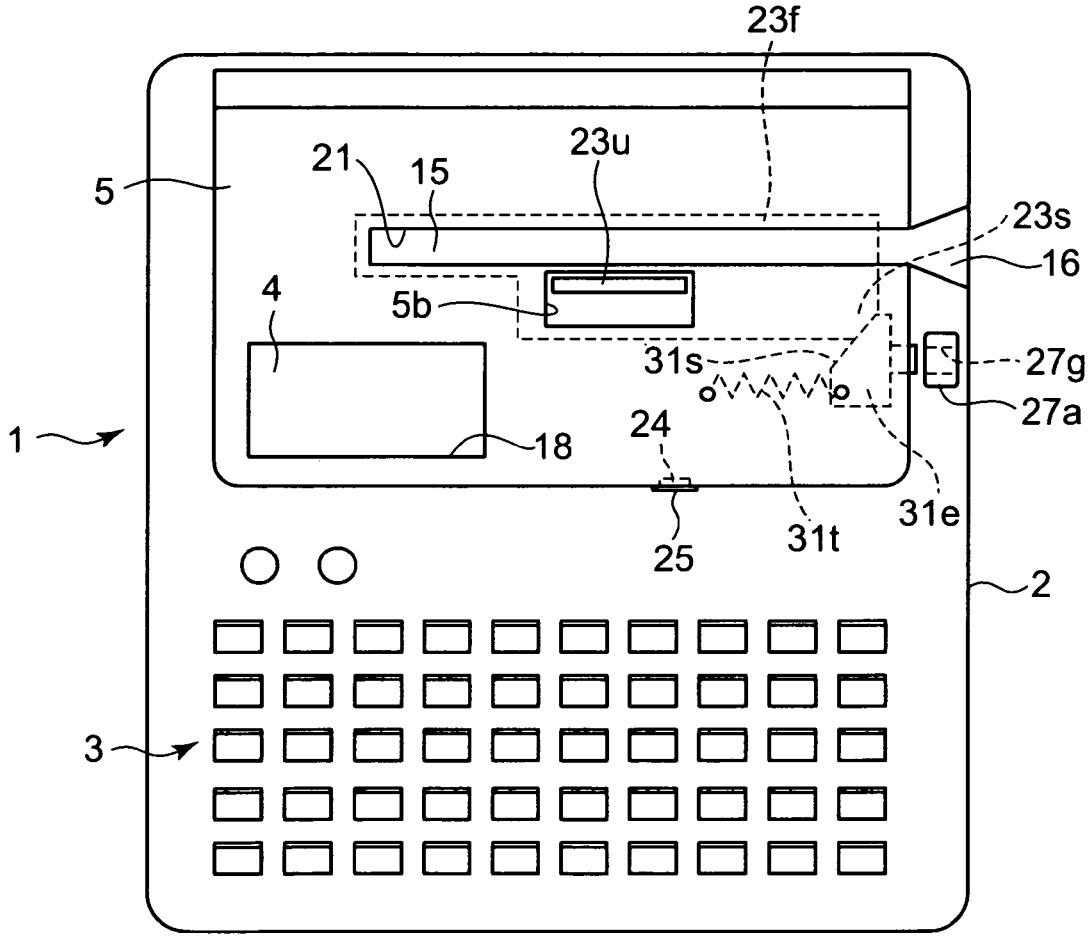
FIG. 34 is a plan view of a sixth embodiment of the printer according to the present invention.

FIG. 34 illustrates a printer of a sixth embodiment. In this printer 1, an inlet cover 23*f* is provided on the back of the cover 5 so as to be slidable by a predetermined distance in a direction perpendicular to the inlet 21 provided in the cover 5. The inlet cover 23*f* has a knob 23*u* appearing outside the printer 1 from a hole 5*b* provided in the cover 5. A lock member 31*e* is provided adjacent to the operation button 27*a* on the back of the cover 5 so as to protrude into and move away from the operation button 27*a*. The inlet cover 23*f* and the lock member 31*e* have at corners thereof sliding edges 23*s* and 31*s* inclined at 45 degrees to the horizontal such that they are in slidable contact with each other at their edges 23*s* and 31*e*. A spring 31*t* is provided between the lock member 31*e* and the cover 5 such that the spring 31*t* biases the lock member 31*e* at all times to move away from the hole 27*g* in the operation button 27*a*.

As shown in FIG. 34, the lock member 31*e* is biased to move away from the hole 27*g* in the operation button 27*a* by the spring 31*t* when no optical disk D is loaded in the printer body 2. Thus, the inlet cover 23*f* is at a position where the cover 23*f* is pushed by the sliding edge 31*s* of the lock member 31*e*, thereby blocking up the inlet 21. When the user loads the optical disk D into the printer body 2, the knob 23*u* is moved toward the front side of the printer body 2 so as to move the inlet cover 23*f* to its open position where the inlet 21 is opened through which the optical disk D is then inserted into the printer body 2. When the inlet cover 23*f* is moved to its open position, the lock member 31*e* is pushed into the hole 27*g* in the operation button 27*a* because the inlet cover 23*f* and the lock member 31*e* are in contact with each other at their sliding edges 31*s* and 23*s*. Thus, the operation button 27*a* is locked inoperable. Accordingly, when the optical disk D is loaded into the printer body 2, the engagement of the cover 5 with the printer body 2 cannot be released by operating the operation button 27*a*. Thus, a wrong operation such as opening the cover 5 inadvertently is prevented.

Figure 35:
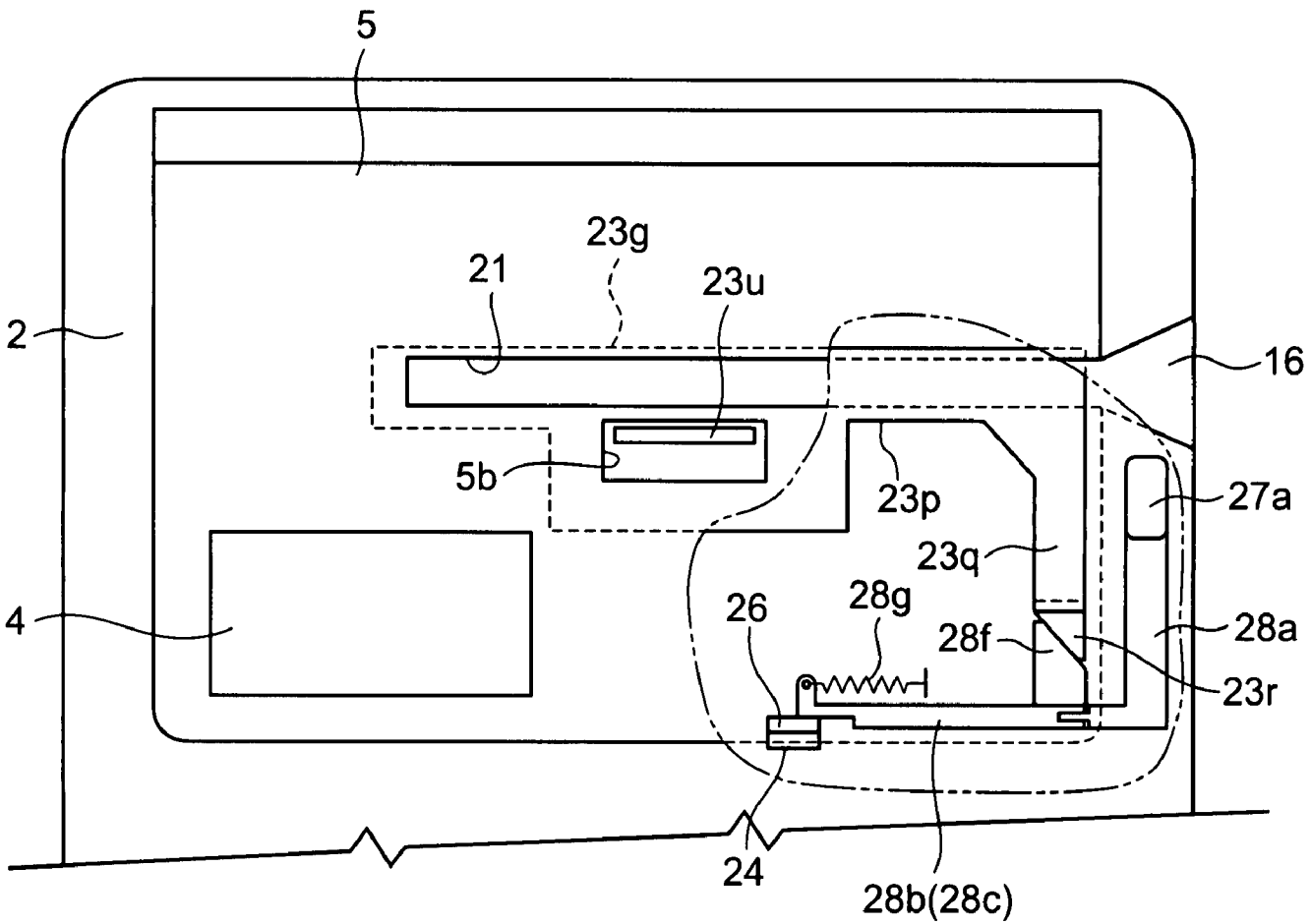
FIG. 35 is a plan view of a seventh embodiment of the printer according to the present invention with a part thereof broken away.

FIG. 35 shows a printer of a seventh embodiment. While in the fourth embodiment the inlet cover is arranged to be moved automatically to its open position in conjunction with loading of the optical disk D into printer body 2, the printer of the seventh embodiment is different from the fourth embodiment in that the inlet cover is manually moved to its open position. The remaining structure of the seventh embodiment is the same as that of the fourth embodiment of FIGS. 27-30. As shown in FIG. 35, an inlet cover 23*g* is provided on the back of the cover 5 so as to be slidable by a predetermined distance in a direction perpendicular to the extending direction of the inlet 21. The inlet cover 23*g* has a knob 23*u* appearing outside the printer body 2 through a hole 5*b* provided in the cover 5. In FIGS. 35 and 27-30, like reference numerals are used to denote like parts of the seventh and fourth embodiments, and further description thereof will be omitted. In the printer of the seventh embodiment, the user moves the knob 23*u* manually toward the front of the printer body 2 to move the inlet cover 23*g* to its open position, thereby revealing the inlet 21, and then inserts an optical disk D through the inlet 21 into the printer body 2. When the inlet cover 23*g* moves to its open position, the lever pieces 28*a* and 28*b* of the separable connection lever 28 are separated. Thus, although the user can push the operation button 27*a* when the optical disk D is loaded into the printer body 2, the pushing force of the operation button 27*a* is not transmitted to the engaging element 26 and the operation of the operation button 27*a* by the user is invalidated.

Figure 36:
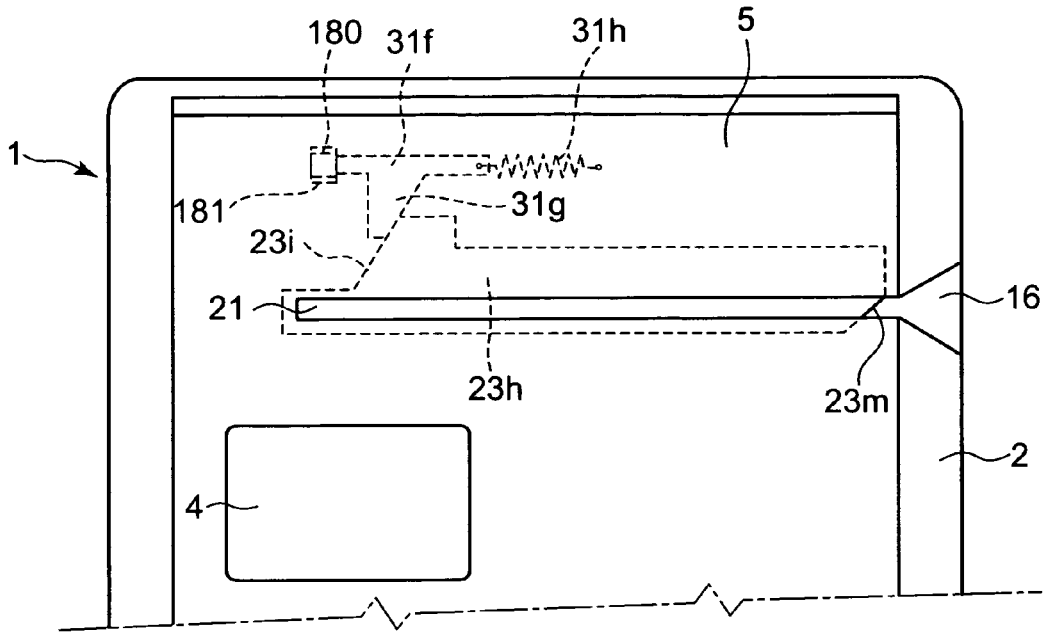
FIG. 36 is a plan view of a part of an eighth embodiment of the printer according to the present invention.
Figure 37:
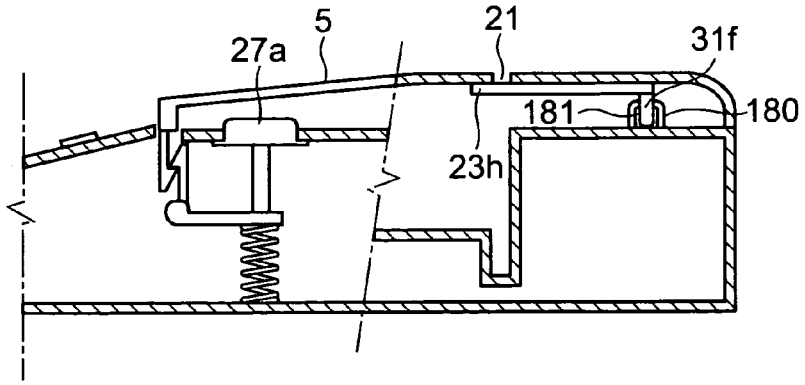
FIG. 37 is a partially cross-sectional view of this printer.

FIGS. 36 and 37 show a printer of an eighth embodiment. When the optical disk D is loaded into the printer body 2, the respective above-mentioned printers disable or invalidate the operation of the operation button to release the engagement of the cover 5 with the printer body 2, thereby preventing the cover 5 from being opened inadvertently. In contrast, in the eighth embodiment the cover 5 is locked to the printer body 2 so as not to be opened when the optical disk D is loaded into the printer body 2.

In FIGS. 36 and 37, an inlet cover 23*h* is provided slidable on the back of the cover 5 by a predetermined length in a direction perpendicular to the direction in which the inlet 21 provided in the cover 5 extends. An inclined edge 23*m* is formed on a right end of the inlet cover 23*h* adjacent to the opening 16 in the printer body 2. An engaging member 180 having a through hole 181 is provided on the printer body 2 and covered by the cover 5. A lock member 31*f* is provided adjacent to the engaging member 180 on the back of the cover 5 so as to be insertable into the through hole 180*a* in the engaging member 180.

The inlet cover 23*h* has in the vicinity of its left end an edge 23*i* inclined at 45 degrees to the longitudinal axis thereof on which the lock member 31*f* is slidable at an edge 31*g* of a protrusion thereof extending toward the inlet cover 23*h* and inclined at 45 degrees to the longitudinal axis thereof A spring 31*h* is provided between the lock member 31*f* and the cover 5 so as to bias the lock member 31*f* to move away from the hole 181 in the engaging element 180.

When no optical disk D is loaded in the printer body 2, the inlet cover 23*h* blocks up the inlet 21 in the cover 5. At this time, the lock member 31*f* is disengaged from the engaging member 180 and the cover 5 is openable manually. When an optical disk D is loaded into the printer 2 through the inlet 21, the optical disk D hits the inclined edge 23*m* of the inlet cover 23*h* at the leading edge thereof, thereby moving the cover 23*h* toward the rear of the printer body 2 and hence to the position where the inlet 21 is revealed. In conjunction with this movement, the lock member 31*f* moves towards the engaging member 180 against the resiliency of the spring 31*h* and then enters the hole 181 in the engaging member 180, thereby causing the cover 5 to be locked to the printer body 2. Thus, even when the hook 24 is released from the engaging element 26 by operating the operation button 27*a*, the cover 5 cannot be opened because the cover 5 is locked to the printer body 2 in conjunction with the loading of the disk D into the printer body 2. When the optical disk D is removed from the printer body 2, the inlet cover 23*h* returns to its initial position, thereby disengaging the lock member 31*f* from the engaging member 180 and unlocking the cover 23*h*. Thus, the cover 5 is openable.

Figure 38:
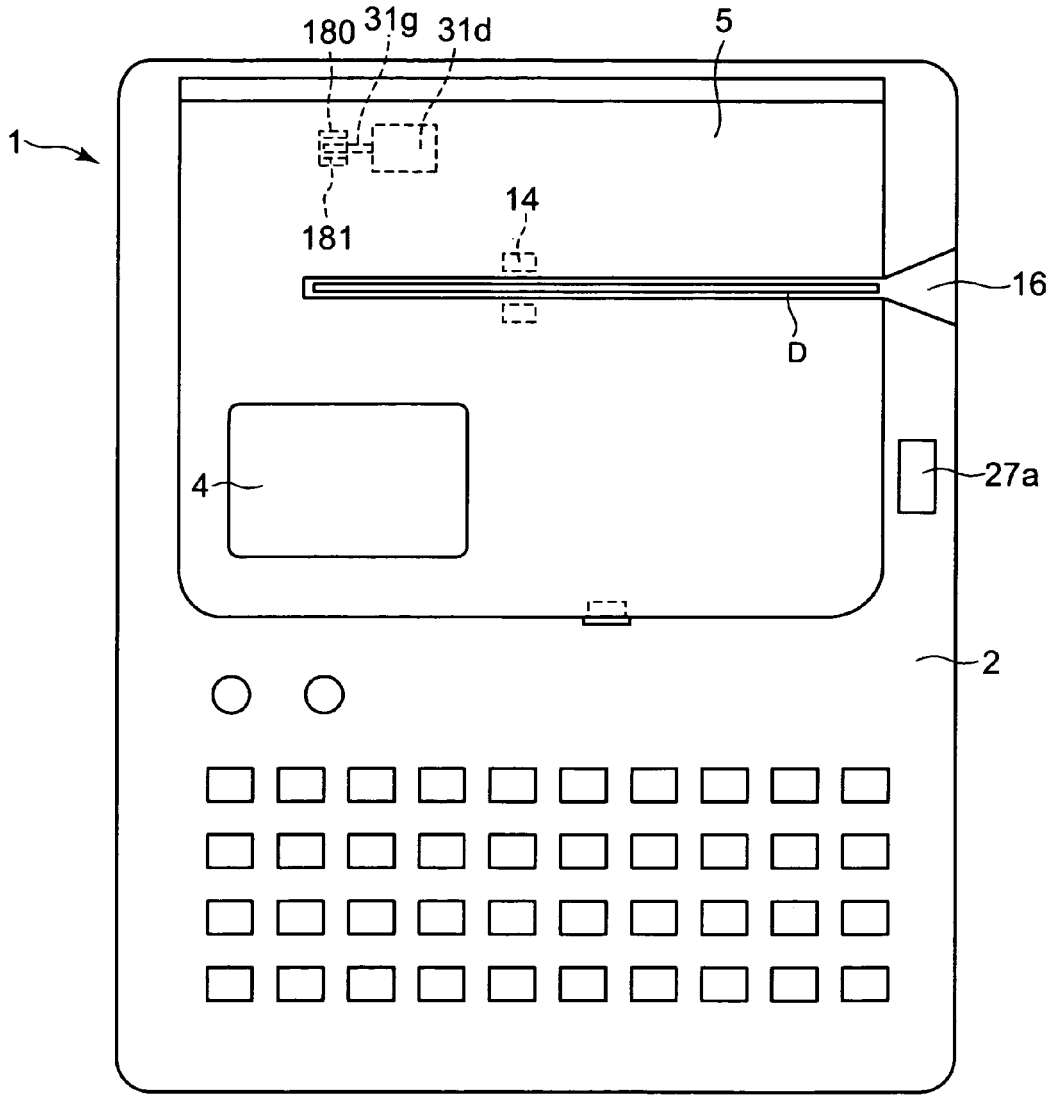
FIG. 38 is a plan view of a ninth embodiment of the printer according to the present invention.

FIG. 38 shows a printer of a ninth embodiment in which a lock member 31*g* driven by a solenoid 31*d* is disposed on the back of the cover 5. An engaging element 180 having a through hole 181 is provided at a predetermined position covered by the cover 5 on the printer body 2. A recording medium sensor 14 is provided across the conveyance path 15 in the printer body 2.

When the recording medium sensor 14 senses that an optical disk D is loaded into the printer body 2, the controller drives the solenoid 31*d* such that the lock member 31*g* protrudes toward the engaging member 180, thereby engaging with the lock member 31*g* and hence preventing the cover 5 from being opened. When the recording medium sensor 14 detects that the optical disk D is removed from the printer body 2, the controller stops driving the solenoid 31*d* such that the lock member 31*h* moves away from the hole 181 in the engaging member 180, thereby releasing the locked state of the cover 5. Thus, when the optical disk D is loaded in the printer body 2 even in the printer of the ninth embodiment, the cover 5 is locked to the printer body 2, thereby preventing the cover 5 from being opened inadvertently.

While the printing mechanisms for the recording mediums in the above embodiments comprise the thermal head and the platen provided at the predetermined positions such that the thermal head prints on the optical disk under conveyance at the predetermined position, the arrangement may be such that the thermal head is moved to and prints on the optical disk supported at a predetermined position in the printer body 2. While in the above embodiments the printers also capable of printing on a tape-like printing medium are illustrated, the present invention is not limited to such printers. The present invention is applicable to printers having only a printing function for a recording medium such as an optical disk, of course. While the printers having the printing mechanism of a thermal transfer system have been illustrated, the present invention is applicable to printers having a printing mechanism of an ink jet system.

As described above, according to the present invention the printers are provided which prevent occurrence of troubles of damaging a recording medium inserted into the printer body through the inlet in the cover that covers printing expendables receiving section within the printer body, due to inadvertently opening of the cover and improper handling of the printer such as incomplete closing of the printer body with the cover. Thus, good printing is performed on the recording medium.

Various modifications and changes may be made thereunto without departing from the broad spirit and scope of this invention. The above-described embodiments are intended to illustrate the present invention, not to limit the scope of the present invention. The scope of the present invention is shown by the attached claims rather than the embodiments. Various modifications made within the meaning of an equivalent of the claims of the invention and within the claims are to be regarded to be in the scope of the present invention.

This application is based on Japanese Patent Application Nos. 2005-129443 and 2006-075541 filed on Apr. 27, 2005, and Mar. 17, 2006, respectively, and each including specification, claims, drawings and summary. The disclosures of the above Japanese patent applications are incorporated herein by reference in their entirety.

What is claimed is:

1. Printer for printing information on a recording medium on which data is recordable, the printer comprising:

a printing mechanism for printing information on the recording medium;

a printer body containing the printing mechanism and having therein an opening through which printing expendables are exchangeably received within the printer body;

a printer cover provided to be openable on the printer body so as to cover the opening, the printer cover having therein an inlet through which the recording medium is loaded into the printer body so as to appear partially outside the printer body;

inhibiting means for inhibiting the printer cover from being manually opened when the recording medium has been loaded into the printer body; and engagement releasing means including an operation unit that is operated manually from outside the printer to release an engagement of the printer cover with the printer body performed by engaging means for engaging the printer cover with the printer body;

wherein the inhibiting means comprising engagement release inhibiting means for inhibiting the operation of the engagement releasing means.

2. The printer of claim 1, wherein the engagement release inhibiting means comprises:

an interlock mechanism that moves from an initial position thereof to a predetermined position thereof in conjunction with loading of the recording medium into the printer body and returns from the predetermined position thereof to the initial position thereof in conjunction with removal of the recording medium from the printer body; and operation stopping means for stopping operation of the operation unit in conjunction with movement of the interlock mechanism from its initial position to its predetermined position, and for releasing the stopping of the operation of the operation unit in conjunction with movement of the interlock mechanism from its predetermined position to its initial position.

3. The printer of claim 2, wherein the interlock mechanism comprises:

an inlet cover provided to be turnable on the printer cover so as to cover the inlet in the printer cover, the inlet cover being pressed by the recording medium inserted into the printer body so as to move from a closing position thereof where the inlet cover covers the inlet to an open position thereof where the inlet appears and return from the open position thereof to the closing position thereof when the recording medium is removed from the printer body; and wherein the operation stopping means comprises:

a locking member that moves in conjunction with movement of the inlet cover from its closing position to its open position to a lock position where the locking member engages with the operation unit, thereby disabling the operation of the operation unit, and that moves in conjunction with movement of the inlet cover from its open position to its closing position to a non-lock position where the locking member releases the engagement of the locking member with the operation unit, thereby rendering the operation unit operable manually.

4. The printer of claim 2, wherein the interlock mechanism comprises:

a movable member provided in the vicinity of a position where the recording medium is loaded into the printer body, the movable member being biased so as to return to an initial position thereof, the moving member being pressed by the recording medium inserted into the printer body so as to move from the initial position thereof to a predetermined position thereof, and returning from the predetermined position thereof to the initial position thereof in response to the recording medium being removed from the printer body; and wherein the operation stopping means comprises:

a locking member that moves in conjunction with the movement of the movable member from its initial position to its predetermined position to a locked position thereof where the locking member engages with the operation unit, thereby disabling the operation of the operation unit, and that moves in conjunction with the returning operation of the moving member from its predetermined position to its initial position to an unlock position thereof where the locking member releases the engagement with the operation unit, thereby rendering the operation unit operable.

5. The printer of claim 1, wherein the engagement release inhibiting means comprises:

an interlock mechanism that moves from an initial position thereof to a predetermined position thereof in conjunction with loading of the recording medium into the printer body and returns from the predetermined position thereof to the initial position thereof in conjunction with removal of the recording medium from the printer body; and shielding means for shielding the operation unit in conjunction with the movement of the interlock mechanism from its initial position to its predetermined position, thereby disabling manual operation of the operation unit and for releasing the shielding of the operation unit in conjunction with the returning operation of the interlock mechanism from its predetermined position to its initial position.

6. The printer of claim 5, wherein the interlock mechanism comprises:

an inlet cover provided to be turnable on the printer cover for covering the inlet in the printer cover, the inlet cover being pressed by the recording medium loaded into the printer body to move from a closing position thereof where the inlet cover closes the inlet to an open position thereof where the inlet cover opens the inlet, and responsive to the recording medium being removed from the printer body to return from the open position thereof to the closing position thereof; and wherein the shielding means comprises:

a shield provided on the inlet cover, the shield opening the operation unit to the outside when the inlet cover is at its closing position and shielding the operation unit from the outside when the inlet cover is at its open position.

7. The printer of claim 1, wherein the engagement release inhibiting means comprises:

an interlock mechanism that moves from an initial position thereof to a predetermined position thereof in conjunction with the recording medium being loaded into the printer body and returns from its predetermined position to its initial position in conjunction with the recording medium being removed from the printer body; and cutoff means provided in the engagement releasing means for cutting off transmission of an operation force of the operation unit to the engaging means to invalidate the operation of the operation unit in conjunction with the interlock mechanism moving from its initial position to its predetermined position and for releasing the cutoff of the transmission of the operation force of the operation unit performed by the engagement releasing means to make the operation of the operation unit effective in conjunction with the interlock mechanism returning from its predetermined position to its initial position.

8. The printer of claim 7, wherein the interlock mechanism comprises a movable member provided in the vicinity of a position where the recording medium is loaded into the printer body, the movable member being biased so as to return to an initial position thereof, the movable member being pressed by the recording medium loaded into the printer body, thereby moving from the initial position thereof to a predetermined position thereof, and the movable member being responsive to the recording medium being removed from the printer body to return from the predetermined position thereof to the initial position thereof;

wherein the engagement releasing means comprises a pair of pieces separably connected to each other at one end and to the operation unit and the engaging means, respectively, at the other end; and wherein the cutoff releasing means separates the pair of pieces in conjunction with movement of the movable member from its initial position to its predetermined position, and connecting the pair of pieces in conjunction with movement of the movable member from its predetermined position to its initial position.

9. The printer of claim 1, wherein the engagement release inhibiting means comprises:

detecting means for detecting that the recording medium is loaded into the printer body;

locking means movable between a locked position thereof where the operation unit is locked and an unlocked position thereof where the operation unit is unlocked;

drive means for moving the locking means between the locked and unlocked positions; and control means, responsive to the detecting means detecting that the recording medium is loaded in the printer body, for moving the locking means to the locked position and responsive to the detecting means detecting that no recording medium is loaded into the printer body, for moving the locking means to the unlocked position.

10. The printer of claim 9, wherein the drive means comprises a solenoid.

11. The printer of claim 1, wherein the engagement release inhibiting means comprises:

an inlet cover provided to be openable on the printer cover for covering the inlet in the printer cover, the inlet cover being opened manually when the recording medium is loaded into the printer body; and locking means for preventing operation of the operation unit in conjunction with the opening of the inlet cover.

12. The printer of claim 1, wherein the engagement release inhibiting means comprises:

an inlet cover provided on the printer cover for covering the inlet in the printer cover, the inlet cover being opened manually when the recording medium is loaded into the printer body; and cutoff means included in the engagement releasing means for interrupting transmission of an operation force by the operation unit to the engaging means to invalidate the operation of the operation unit in conjunction with the opening of the inlet cover.

13. The printer of claim 1, wherein the printing mechanism comprises:

conveying means for conveying the recording medium, inserted into the inlet in the printer cover with a part of the recording medium appearing outside the printer body, along a conveyance path formed along the inlet within the printer body; and a printing head for printing on the recording medium conveyed by the conveying means.

14. The printer of claim 13, wherein the conveying means conveys in an upstanding state the recording medium loaded into the printer body.

15. The printer of claim 13, wherein:

the expendables comprise an ink cartridge that contains an ink ribbon;

the conveying means conveys in a superimposed manner the recording medium and the ink ribbon contained in the ink cartridge; and the printing head prints on the recording medium conveyed by the conveying means by thermally transferring an ink in the ink ribbon of the ink cartridge to the recording medium.

16. The printer of claim 1, wherein the printing mechanism is adapted to print on an optical disk.

17. Printer for printing information on a recording medium on which data is recordable, the printer comprising:

a printing mechanism for printing information on the recording medium;

a printer body containing the printing mechanism and having therein an opening through which printing expendables are exchangeably received within the printer body;

a printer cover provided to be openable on the printer body so as to cover the opening, the printer cover having therein an inlet through which the recording medium is loaded into the printer body so as to appear partially outside the printer body; and inhibiting means for inhibiting the printer cover from being manually opened when the recording medium has been loaded into the printer body;

wherein the inhibiting means comprises:

an interlock mechanism that moves from an initial position thereof to a predetermined position thereof in conjunction with the recording medium being loaded into the printer body and that returns from the predetermined position thereof to the initial position thereof in conjunction with the recording medium being removed from the printer body; and locking means for locking the printer cover in an unopenable manner to the printer body in conjunction with movement of the interlock mechanism from its initial position to its predetermined position, and for unlocking the printer cover from the printer body in conjunction with return of the interlock mechanism from its predetermined position to its initial position.

18. Printer for printing information on a recording medium on which data is recordable, the printer comprising:

a printing mechanism for printing information on the recording medium;

a printer body containing the printing mechanism and having therein an opening through which printing expendables are exchangeably received within the printer body;

a printer cover provided to be openable on the printer body so as to cover the opening, the printer cover having therein an inlet through which the recording medium is loaded into the printer body so as to appear partially outside the printer body; and inhibiting means for inhibiting the printer cover from being manually opened when the recording medium has been loaded into the printer body;

wherein the inhibiting means comprises:

detecting means for detecting that the recording medium is loaded into the printer body;

locking means movable between a locked position thereof where the printer cover is locked to the printer body and an unlocked position thereof where the printer cover is unlocked from the printer body;

drive means for moving the locking means between the locked and unlocked positions; and control means, responsive to the detecting means detecting that the recording medium is loaded in the printer body, for moving the locking means to the locked position and responsive to the detecting means detecting that no recording medium is loaded into the printer body, for moving the locking means to the unlocked position.

19. The printer of claim 18, wherein the drive means comprises a solenoid.

* * * * *